US007980653B2

(12) United States Patent
Komatsu et al.

(10) Patent No.: US 7,980,653 B2
(45) Date of Patent: Jul. 19, 2011

(54) EJECTION INSPECTING DEVICE, PRINTING DEVICE, AND EJECTION INSPECTING METHOD

(75) Inventors: Shinya Komatsu, Shiojiri (JP); Hironori Endo, Okaya (JP); Yuji Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 493 days.

(21) Appl. No.: 12/208,034

(22) Filed: Sep. 10, 2008

(65) Prior Publication Data

US 2009/0066743 A1 Mar. 12, 2009

(30) Foreign Application Priority Data

Sep. 11, 2007 (JP) ..... 2007-235335

(51) Int. Cl.
*B41J 29/393* (2006.01)

(52) U.S. Cl. ..... 347/19; 347/81

(58) Field of Classification Search ..... 347/7–9, 347/12, 19, 37, 54, 81
See application file for complete search history.

(56) References Cited

U.S. PATENT DOCUMENTS

2010/0165034 A1* 7/2010 DeVore et al. ..... 347/19

FOREIGN PATENT DOCUMENTS

JP 59-123673 7/1984

* cited by examiner

*Primary Examiner* — Thinh H Nguyen
(74) *Attorney, Agent, or Firm* — Maschoff Gilmore & Israelson

(57) ABSTRACT

An ejection inspecting device which inspects an ejection state of an ejection head, including nozzles ejecting fluid, includes fluid receiving areas corresponding to the ejection head so as to receive the fluid ejected from the nozzles. A potential difference generating unit generates predetermined potential differences between the ejection head and the fluid receiving areas. Electrical variation detecting units detect electrical variations of the fluid receiving areas. A control unit drives the ejection head to eject the fluid to the fluid receiving areas from the nozzles in a state in which the predetermined potential differences are generated between the ejection head and the fluid receiving areas by the potential difference generating unit. The ejection inspecting device also inspects the nozzles to determine whether the fluid is ejected from the nozzles on the basis of the detection results of the electrical variation detecting units in the fluid receiving areas.

12 Claims, 13 Drawing Sheets

EJECTION INSPECTING DEVICE, PRINTING DEVICE, AND EJECTION INSPECTING METHOD

BACKGROUND

1. Technical Field

The present invention relates to an ejection inspecting device, a printing device, and an ejection inspecting method.

2. Related Art

In the past, as an ejection inspecting device, there has been known a device which generates a predetermined potential difference between a print head of an ink jet printer and an ink droplet receiving area (ink receiving area) provided at a position opposed to the print head to charge ink droplets ejected from a nozzle, allows the charged ink droplets to fly to the ink receiving area, and inspects whether the ink droplets are ejected from the nozzle by detecting a voltage variation (induction voltage) that is generated in the ink receiving area by the reaching of the ink droplets to the ink receiving area (JP-A-59-123673 (FIG. 5)).

However, in the device described in JP-A-59-123673, one ink receiving area is provided for one print head. Accordingly, for example, when a large number of nozzles are included in the print head, there is a problem in that a period of time for nozzle inspection increases in accordance with the number of nozzles. In addition, it is preferable that the nozzle inspection is more accurately performed.

SUMMARY

The invention is contrived to solve the problems and an advantage of some aspects of the invention is to provide an ejection inspecting device, a printing device, and an ejection inspecting method with which a period of time for nozzle inspection can be reduced in detection of an electrical variation caused by ejected fluid, and another advantage of some aspect of the invention is to provide an ejection inspecting device, a printing device, and an ejection inspecting method with which nozzle inspection can be more accurately performed in detection of an electrical variation caused by ejected fluid.

In order to embody at least one of the above-mentioned advantages, the following means are employed.

An ejection inspecting device according to a first aspect of the invention, which inspects an ejection state of an ejection head including a plurality of nozzles ejecting fluid, includes a plurality of fluid receiving areas corresponding to the ejection head so as to receive the fluid ejected from the plurality of nozzles, a potential difference generating unit which generates predetermined potential differences between the ejection head and the fluid receiving areas, a plurality of electrical variation detecting units which are connected to the plurality of fluid receiving areas so as to detect electrical variations of the fluid receiving areas, and a control unit which drives the ejection head so as to eject the fluid to the plurality of fluid receiving areas from the nozzles in a state in which the predetermined potential differences are generated between the ejection head and the fluid receiving areas by the potential difference generating unit and performs nozzle inspection for inspecting whether the fluid is ejected from the nozzles on the basis of the detection results of the electrical variation detecting units in the fluid receiving areas.

In this ejection inspecting device, in a state in which a predetermined potential is generated between the ejection head including the plurality of nozzles ejecting fluid and the plurality of fluid receiving areas corresponding to the ejection head so as to receive the fluid ejected from the plurality of nozzles, the ejection head is driven so as to eject the fluid to the plurality of fluid receiving areas from the nozzles and nozzle inspection processes of inspecting whether the fluid is ejected from the nozzles are performed in parallel on the basis of the detection results of the electrical variation detecting units in the fluid receiving areas. Herein, for example, in an ejection inspecting device including one fluid receiving area for one ejection head, the electrical variation of the fluid ejected from one nozzle is sequentially detected. However, according to this embodiment of the invention, the plurality of fluid receiving areas and the plurality of electrical variation detecting units are provided so as to correspond to the ejection head to perform the plurality of nozzle inspection processes in parallel. Accordingly, in detection of the electrical variations caused by the elected fluid, a period of time for nozzle inspection can be reduced. Herein, "perform the nozzle inspection processes in parallel" means the nozzle inspection processes for the nozzles are performed at the same time. At this time, in the ejection head, a nozzle array in which the nozzles are arranged in a predetermined arrangement direction may be formed.

With the ejection inspecting device according to the first aspect of the invention, it is preferable that the plurality of fluid receiving areas include a first fluid receiving area including one or more of the fluid receiving areas provided so as to be opposed to the ejection head and a second fluid receiving area including one or more of the fluid receiving areas provided so as to be arranged parallel to the first fluid receiving area, and it is preferable that a moving mechanism is provided to move at least one of the ejection head and the fluid receiving areas to a position at which the first fluid receiving area and the ejection head are opposed to each other and a position at which the second fluid receiving area and the ejection head are opposed to each other. In this manner, the detected values of the electrical variations can be kept constant with the distance between the ejection head and the plurality of fluid receiving areas kept constant, and thus a period of time for nozzle inspection can be reduced and the nozzle inspection can be more accurately performed. At this time, the moving mechanism may move the ejection head in which the nozzle array having the nozzles arranged in the predetermined arrangement direction is formed in a direction perpendicular to the arrangement direction.

With the ejection inspecting device according to the first aspect of the invention, a nozzle array in which the nozzles are arranged in a predetermined arrangement direction is formed in the ejection head, and it is preferable that the plurality of fluid receiving areas include a first fluid receiving area including one or more of the fluid receiving areas provided so as to be opposed to the ejection head and a second fluid receiving area including one or more of the fluid receiving areas provided in the arrangement direction of the nozzles at a distance different from a distance between the first fluid receiving area and the ejection head. In this manner, it is not necessary to move the ejection head during the nozzle inspection and thus a period of time for nozzle inspection can be reduced in comparison with the case where the ejection head is moved during the nozzle inspection. At this time, in the end area in which the first fluid receiving area and the second fluid receiving area overlap with each other, the control unit may not perform the nozzle inspection in the first fluid receiving area and the nozzle inspection in the second fluid receiving area in parallel. It is preferable that the control unit does not perform the nozzle inspection in the first fluid receiving area and the nozzle inspection in the second fluid receiving area in parallel in an end area in which the first fluid receiving area and the second fluid receiving area overlap with each other. In the end area in which the first and second fluid receiving areas overlap with each other, it is possible that the fluid ejected from the ejection head lands on any of the first and second fluid receiving areas, and thus the nozzle inspection processes in the first and second fluid receiving areas are not performed in parallel. Accordingly, the nozzle inspection in the end area can be more accurately performed. In addition, the nozzle inspection processes in the areas other than the end area are performed in parallel, and thus a period of time for nozzle inspection can be reduced.

With the ejection inspecting device according to the first aspect of the invention, it is preferable that the plurality of fluid receiving areas include the first fluid receiving area including a plurality of the fluid receiving areas and the second fluid receiving area including a plurality of the fluid receiving areas smaller than those of the first fluid receiving area, it is preferable that a smaller number of the electrical variation detecting units than those of the second fluid receiving area are shared by and connected to the second fluid receiving area, and it is preferable that the control unit individually performs the nozzle inspection in the fluid receiving areas connected in common to the electrical variation detecting units. In this manner, by forming the second fluid receiving area to be smaller than the first fluid receiving area, a period of time for individually performing the nozzle inspection in the second fluid receiving area can be reduced, and by sharing the electrical variation detecting units, the configuration can be simplified.

With the ejection inspecting device according to the first aspect of the invention, it is preferable that the plurality of fluid receiving areas include the first fluid receiving area including a plurality of the fluid receiving areas which are arranged at intervals so as to be opposed to the nozzles of the ejection head and the second fluid receiving area including a plurality of the fluid receiving areas which are arranged at intervals so as to be opposed to the nozzles of the ejection head corresponding to the areas of the predetermined intervals. In this manner, the fluid receiving areas of the first and second fluid receiving areas can be arranged at intervals and mutual interference can be suppressed, and thus the nozzle inspection can be more accurately performed.

With the ejection inspecting device according to the first aspect of the invention, it is preferable that the first fluid receiving area and the second fluid receiving area are arranged such that the nozzles opposed to the first fluid receiving area and the nozzles opposed to the second fluid receiving area partially overlap with each other. In this manner, accuracy of the positioning of the fluid receiving areas can be mitigated.

With the ejection inspecting device according to the first aspect of the invention, it is preferable that a nozzle array in which the nozzles are arranged in a predetermined arrangement direction is formed in the ejection head, it is preferable that the plurality of fluid receiving areas are arranged at intervals in the arrangement direction of the nozzles, and it is preferable that a moving mechanism is provided to move at least one of the ejection head and the plurality of fluid receiving areas in the arrangement direction of the nozzles to a position at which the plurality of fluid receiving areas and a predetermined nozzle group included in the ejection head are opposed to each other and a position at which the plurality of fluid receiving areas and the nozzles other than the predetermined nozzle group are opposed to each other. In this manner, by moving at least one of the plurality of fluid receiving areas and the ejection head, the fluid ejected from all of the nozzles provided in the ejection head can be received, and thus a period of time for nozzle inspection can be reduced and the plurality of fluid receiving areas can be relatively reduced in space.

With the ejection inspecting device according to the first aspect of the invention, it is preferable that the plurality of fluid receiving areas are electrically insulated from each other. In this manner, the fluid receiving areas can be prevented from being affected by the electrical variations and thus the nozzle inspection can be more accurately performed.

A printing device according to a second aspect of the invention includes an ejection head which includes a plurality of nozzles ejecting fluid to a target and the ejection inspecting device according to Claim 1, which inspects an ejection state of the ejection head. Generally, since the printing device performs printing by ejecting the fluid to the target, and then performs the nozzle inspection. Accordingly, the invention has great significance.

With the printing device according to the second aspect of the invention, it is preferable that the ejection head is a line head in which a nozzle array including the nozzles arranged therein is formed so as to have a length not less than a width of the largest sized one of usable targets. In this manner, a period of time for nozzle inspection of the line head in which a number of nozzles are formed in one ejection head can be reduced.

An ejection inspecting method according to a third aspect of the invention, used to inspect an ejection state of fluid by using an ejection inspecting device which includes an ejection head including a plurality of nozzles for ejecting the fluid, a plurality of fluid receiving areas corresponding to the ejection head so as to receive the fluid ejected from the plurality of nozzles, and a plurality of electrical variation detecting units connected to the plurality of fluid receiving areas and for detecting electrical variations of the fluid receiving areas, includes driving the ejection head so as to eject the fluid to the plurality of fluid receiving areas from the nozzles in a state in which predetermined potential differences are generated between the ejection head and the fluid receiving areas, and performing nozzle inspection for inspecting whether the fluid is ejected from the nozzles on the basis of the detection results of electrical variations of the fluid receiving areas.

In this ejection inspecting method, in a state in which a predetermined potential is generated between the ejection head including the plurality of nozzles ejecting fluid and the plurality of fluid receiving areas corresponding to the ejection head so as to receive the fluid ejected from the plurality of nozzles, the ejection head is driven so as to eject the fluid to the plurality of fluid receiving areas from the nozzles and nozzle inspection processes of inspecting whether the fluid is ejected from the nozzles are performed in parallel on the basis of the detection results of the electrical variation detecting units in the fluid receiving areas. Herein, for example, in an ejection inspecting device including one fluid receiving area for one ejection head, the electrical variation of the fluid ejected from one nozzle is sequentially detected. However, according to this embodiment of the invention, the plurality of fluid receiving areas and the plurality of electrical variation detecting units are provided so as to correspond to the ejection head to perform the plurality of nozzle inspection processes in parallel. Accordingly, in detection of the electrical variations caused by the elected fluid, a period of time for nozzle inspection can be reduced. In this ejection inspecting method, various aspects of the above-mentioned ejection inspecting device may be employed and a step realizing functions of the above-mentioned ejection inspecting device may be added.

A program according to this embodiment of the invention is to realize the steps of the above-mentioned ejection inspecting method in one or more computers. This program may be recorded in a computer-readable recording medium (for example, hard disk, ROM, FD, CD, DVD), delivered from a computer to another computer via a transmission medium (communication network such as internet or LAN), and sent and received in any form. When the program is executed by one computer or by a plurality of computers through a division of the steps, the steps of the above-mentioned ejection inspecting method are executed, and thus the same effect can be obtained as in the case of the ejection inspecting method.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
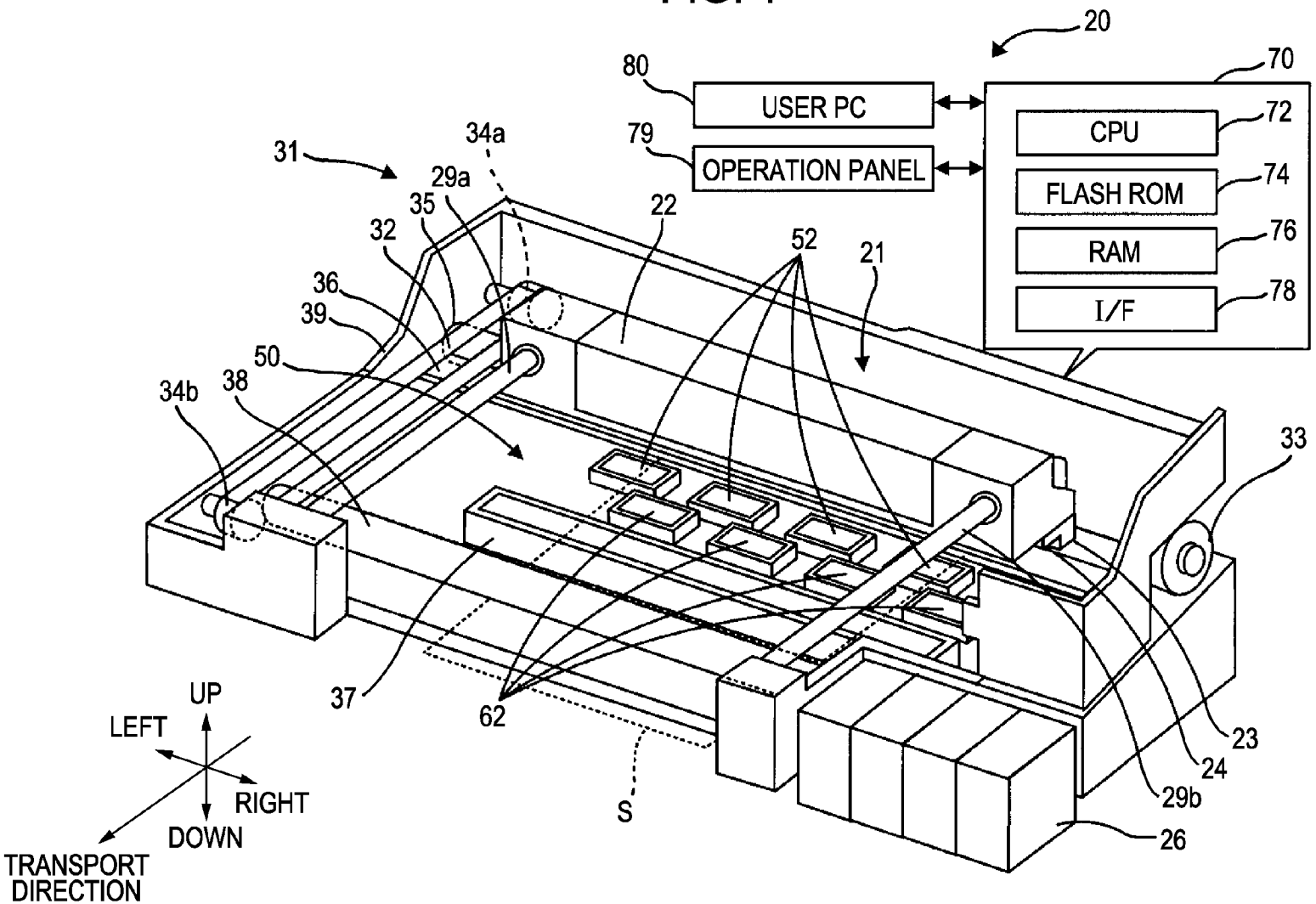
FIG. 1 is a diagram schematically illustrating the configuration of a printer 20 according to a first embodiment.
Figure 2:
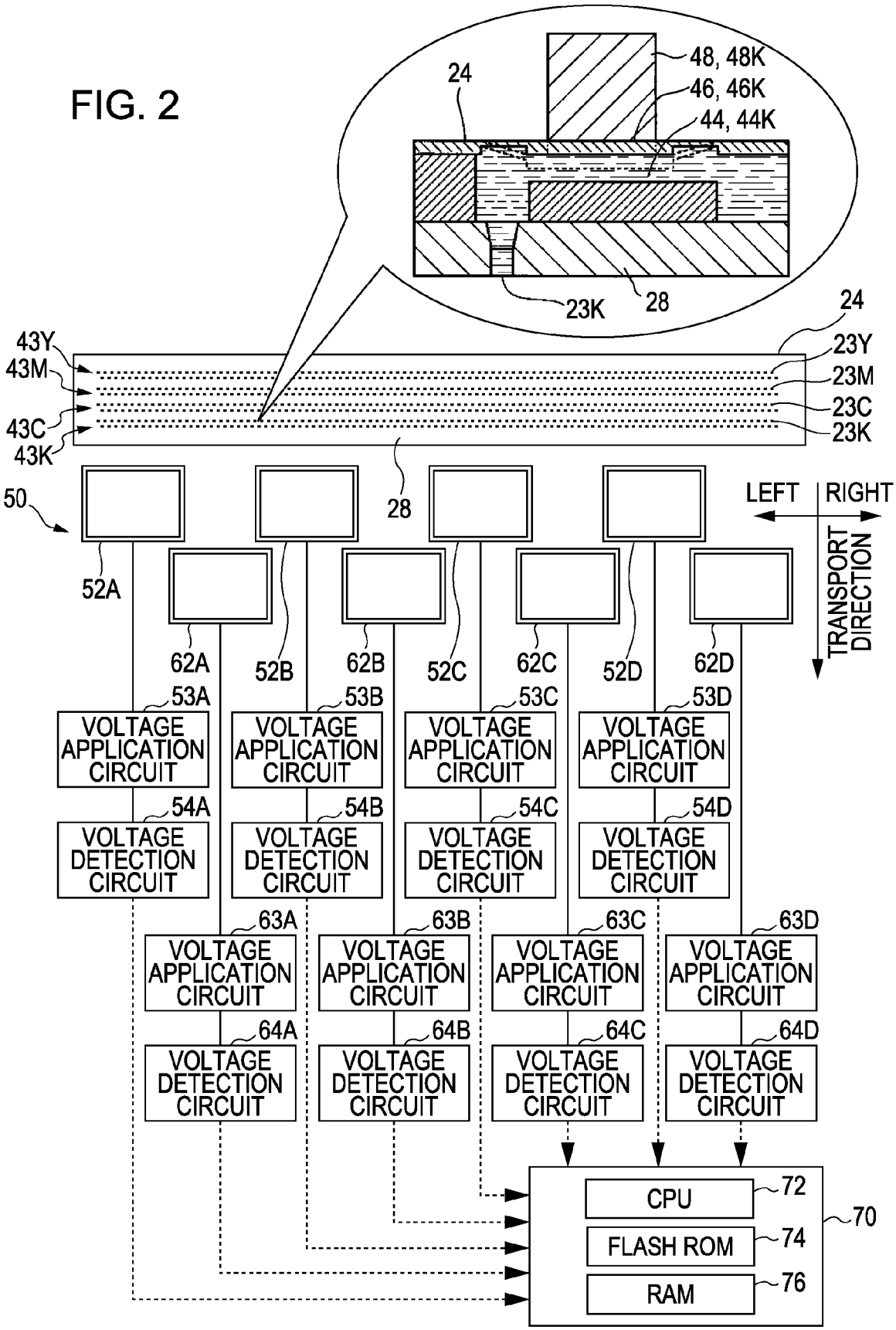
FIG. 2 is a diagram explaining a print head 24 and a nozzle inspection device 50.
Figure 3:
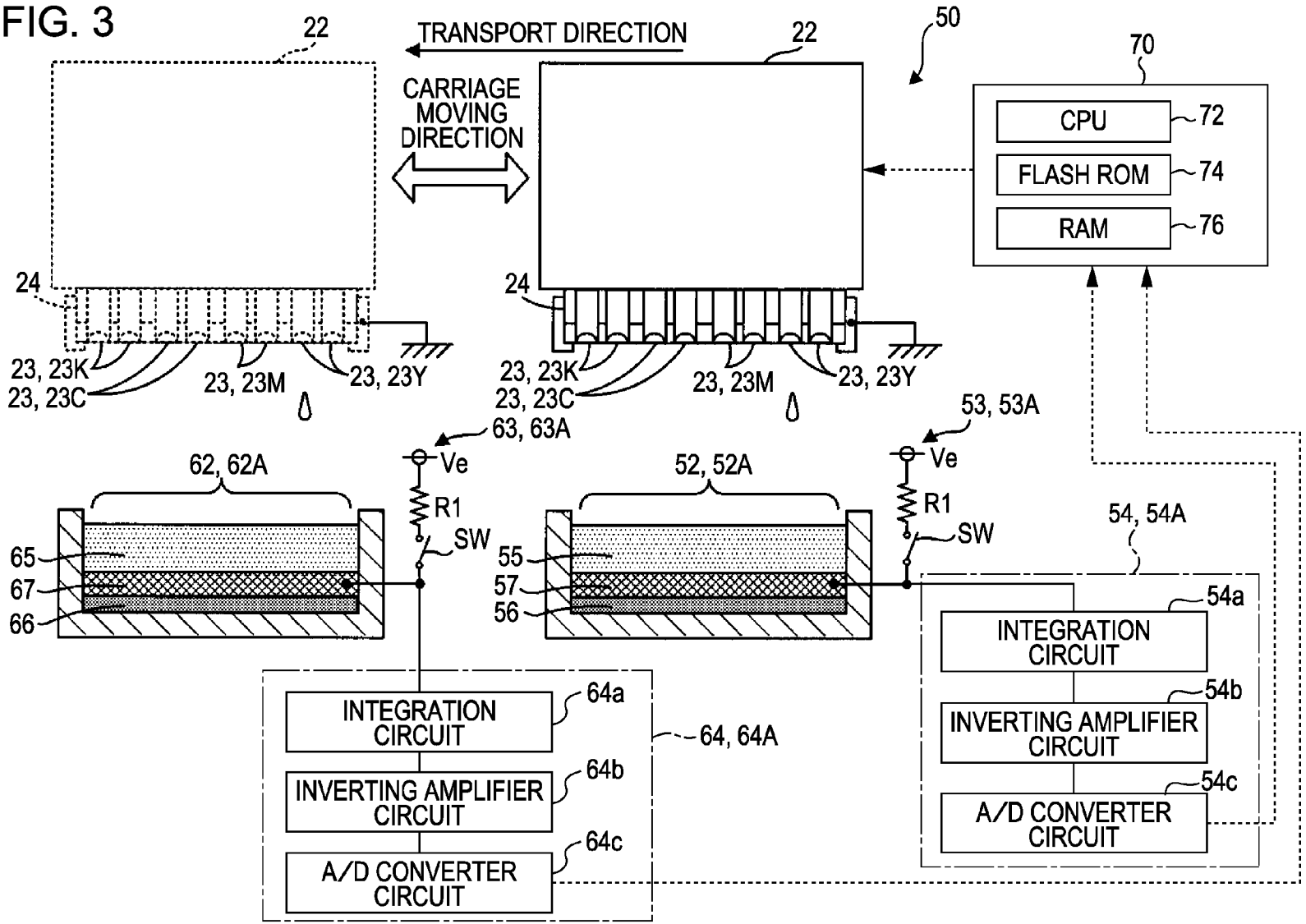
FIG. 3 is a diagram schematically illustrating the configuration of the nozzle inspection device 50.

Next, an embodiment embodying the invention will be described with reference to the accompanying drawings. FIG. 1 is a diagram schematically illustrating the configuration of a printer 20 as this embodiment, FIG. 2 is a diagram explaining a print head 24 and a nozzle inspection device 50, and FIG. 3 is a diagram schematically illustrating the configuration of the nozzle inspection device 50. As shown in FIG. 1, the printer 20 according to this embodiment is configured as an ink jet printer which includes a line head having a length not less than a width of the largest sized one of usable recording sheets S. The printer 20 includes a printer mechanism 21 which ejects ink as fluid to a target recording sheet S transported from the back to the front of the drawing, a head moving mechanism 31 which can move a carriage 22 in a predetermined carriage moving direction, a sheet transport roller 35 and a sheet discharge roller 38 which are driven by a driving motor 33 and transport the recording sheet S in a transport direction, a capping device 37 which is formed in the downstream of a platen 36 in the transport direction of the recording sheet S, a nozzle inspection device 50 which is provided between the platen 36 and the capping device 37 and inspects whether ink droplets are normally ejected from the print head 24, and a controller 70 which controls the whole printer 20.

The printer mechanism 21 includes the carriage 22 which is supported by a carriage belt 32 to move in a front-back direction (carriage moving direction) of a main body along guides 29*a* and 29*b*, the print head 24 which is provided below the carriage 22 and applies a pressure to inks of different colors to eject ink droplets as fluid from nozzles 23, and an ink cartridge 26 which is mounted on a body side and stores the inks of different colors to supply the stored inks to the print head 24 via a tube (not shown). The carriage belt 32 extending between a carriage motor 34*a* mounted on the left-back side of a frame 39 and a driven roller 34*b* mounted on the left-front side of the frame 39 is driven by the carriage motor 34*a*, and thus the carriage 22 moves to the back and the front of the drawing. The head moving mechanism 31 includes the guides 29*a* and 29*b*, the carriage belt 32, the carriage motor 34*a*, and the driven roller 34*b*. The ink cartridge 26 is mounted on the carriage 22 and separately stores the inks of different colors of cyan (C), magenta (M), yellow (Y) and black (K).

As shown in FIG. 2, the print head 24 includes a nozzle plate 28 having the plurality of nozzles 23 formed thereon. The nozzle plate 28 is made of a conductive material (SUS or the like) and is connected to a ground via the guides 29*a* and 29*b*. The nozzle plate 28 is provided with nozzle arrays 43 in which the plurality of nozzles 23 ejecting the inks of different colors of cyan (C), magenta (M), yellow (Y) and black (K) are arranged. Herein, all of the nozzles are collectively referred to as the nozzles 23 and all of the nozzle arrays are collectively referred to as the nozzle arrays 43. The nozzles and the nozzle arrays for cyan are collectively referred to as the nozzles 23C and the nozzle arrays 43C, respectively, the nozzles and the nozzle arrays for magenta are collectively referred to as the nozzles 23M and the nozzle arrays 43M, respectively, the nozzles and the nozzle arrays for yellow are collectively referred to as the nozzles 23Y and the nozzle arrays 43Y, respectively, and the nozzles and the nozzle arrays for black are collectively referred to as the nozzles 23K and the nozzle arrays 43K, respectively. Hereinafter, a description will be given using the nozzles 23K. In the print head 24, the nozzles 23K are arranged in a direction (left-right direction) perpendicular to the transport direction of the recording sheet S so as to have a length not less than the width of the largest sized one of the usable recording sheets S, and thus the nozzle arrays 43K are configured. The nozzles 23K communicates with an ink chamber 44K provided in the print head 24. As for the ink chamber 44K, when a voltage is applied to a piezoelectric element 48K adhering to a vibrating plate 46K which is an upper wall of the ink chamber 44K, the piezoelectric element 48K is deformed and an interior volume is thereby reduced (see the dotted lines in a circle of FIG. 2), and when the application of the volume is stopped, the piezoelectric element 48K returns to its original shape and the reduced interior volume thereby returns to its original volume. In this manner, the ink is ejected from the nozzles 23K. Herein, within one pixel interval (within a period of time for which the recording sheet S passes across one pixel gap), three driving waveforms (pulses) are set so as to be outputted to the piezoelectric elements 48 from the controller 70. The three pulses are referred to as the one segment in this embodiment. Accordingly, when only one pulse is outputted to the piezoelectric element 48K, ink droplets corresponding to one shot are ejected from the nozzles 23K and small size dots (small dots) are formed on the recording sheet S. When two pulses are outputted to the piezoelectric element 48K, ink droplets corresponding to two shots are ejected from the nozzles 23K and medium size dots (medium dots) are formed on the recording sheet S. When three pulses are outputted to the piezoelectric element 48K, ink droplets corresponding to three shots are ejected from the nozzles 23K and large size dots (large dots) are formed on the recording sheet S. In this manner, the printer 20 can form three kinds of sizes of dots by adjusting the ink amount to be ejected in one pixel area. The other nozzles 23Y of the nozzle arrays 43Y, nozzles 23M of the nozzle arrays 43M and nozzles 23C of the nozzle arrays 43C are configured as in the case of the nozzle 23K of the nozzle array 43K. Herein, the print head 24 employs a method of deforming the piezoelectric elements 48 to apply a pressure to the ink, but may employ a method of applying a voltage to a heating resistance element (for example, heater) to heat the ink and generate bubbles to thereby apply a pressure to the ink by the bubbles.

The capping device 37 is provided in the downstream of the transport direction from the platen 36. The capping device 37 is a substantially rectangular-parallelepiped-shaped casing having an opening and has a sealing member made of an insulating material such as silicon rubber at the edge of the opening. The capping device 37 is used in a cleaning treatment including sucking the ink clogging the nozzles 23 and also used to seal the nozzles 23 to prevent the nozzles 23 from being dried during suspension of printing. The capping device 37 is separately connected to a suction pump and an open/close valve (not shown). When the open/close valve is in a closed state and the suction pump operates, a negative pressure is generated in an interior space of the capping device 37. By generating the negative pressure when the capping device 37 seals the nozzles 23, the ink in the nozzles 23 is forcibly sucked.

As shown in FIGS. 2 and 3, the nozzle inspection device 50 includes inspection areas 52 and 62 capable of receiving the ink droplets flying from the nozzles 23 of the print head 24, voltage application circuits 53 and 63 which generates predetermined potential differences between the print head 24 and the inspection areas 52 by controlling the potentials of the inspection areas 52 and 62 to predetermined potentials and voltage detection circuits 54 and 64 which detect voltage variations in the inspection areas 52 and 62. For the convenience of explanation, all of the detection areas are collectively referred to as the inspection areas 52 and 62, all of the voltage application circuits are collectively referred to as the voltage application circuits 53 and 63, all of the voltage detection circuits are collectively referred to as the voltage detection circuits 54 and 64, voltage application circuits 53A to 53D are collectively referred to as the voltage application circuits 53, voltage detection circuits 54A to 54D are collectively referred to as the voltage detection circuits 54, voltage application circuits 63A to 63D are collectively referred to as the voltage application circuits 63, voltage detection circuits 64A to 64D are collectively referred to as the voltage detection circuits 64, inspection areas 52A to 52D are collectively referred to as the first inspection areas 52, and inspection areas 62A to 62D are collectively referred to as the second inspection areas 62. The first inspection areas 52 are provided in the downstream of the transport direction of the platen 36 and include the plurality of inspection areas 52A to 52D. The inspection areas 52A to 52D are disposed at predetermined intervals in a width direction of the recording sheet S. The second inspection areas 62 are provided below the areas of the predetermined intervals of the first inspection areas 52 in the downstream of the transport direction and include the plurality of inspection areas 62A to 62D. The inspection areas 62A to 62D are disposed at predetermined intervals in the width direction of the recording sheet S. As in the case of the first inspection areas 52, the second inspection areas 62 are disposed at predetermined intervals on the same side as the first inspection areas 52 opposed to the print head 24. Further, the first and second inspection areas 52 and 62 are disposed such that the nozzles 23 which are opposed to the first inspection areas 52 by positioning the carriage 22 over the first inspection areas 52 and the nozzles 23 which are opposed to the second inspection areas 62 by positioning the carriage 22 over the second inspection areas 62 partially overlap with each other. The inspection areas 52A to 52D and 62A to 62D have outer circumferential portions made of a conductive material, respectively, are formed independently from each other in a state in which the areas thereof are disposed away from each other, and insulated from each other. The inspection areas 52A to 52D and 62A to 62D have the same configurations. Accordingly, hereinafter, a description will be given using the inspection area 52A for the convenience of explanation.

As shown in FIG. 3, the inspection area 52A is formed as a rectangular area and composed of an upper ink absorber 55 on which ink droplets directly land, a lower ink absorber 56 which absorbs the ink droplets landing on the upper ink absorber 55 and passing therethrough, and a mesh electrode 57 which is disposed between the upper ink absorber 55 and the lower ink absorber 56. The upper ink absorber 55 includes a conductive sponge so as to have the same potential as the electrode 57 and a surface thereof serves as the inspection area 52. This sponge has high permeability such that the landing ink droplets can rapidly move to the lower side. Herein, an ester system urethane sponge (trade name: "Everlight SK-E", manufactured by Bridgestone Corporation) is used as the sponge. The lower ink absorber 56 has a higher ink holding property than the upper ink absorber 55 and includes a nonwoven fabric such as felt. Herein, a nonwoven fabric (trade name: Kino-cloth, manufactured by Oji Kinocloth Co., Ltd) is used as the nonwoven fabric. The electrode 57 is formed as a metal grid mesh made of stainless (for example, SUS). Accordingly, the ink absorbed by the upper ink absorber 55 passes through clearances of the grid electrode 57 and is absorbed and held by the lower ink absorber 56. Herein, since the electrode 57 comes into contact with the conductive upper ink absorber 55, the surface of the upper ink absorber 55, that is, the inspection area 52 has the same potential as the electrode 57.

The voltage application circuit 53A is connected to the electrode 57 of the inspection area 52A. The voltage application circuit 53A is a circuit which boosts the voltage of a several volt electrical wiring formed in the printer 20 to a several ten to several hundred voltage via a booster circuit (not shown) and applies a DC voltage Ve (for example, 400 V) generated after the boosting to the inspection area 52A via a resistance element R1 (for example, 1 MΩ) and a switch SW. The voltage detection circuit 54A is connected to the electrode 57 of the inspection area 52A. The voltage detection circuit 54A detects a voltage variation in the inspection area 52A, which generates when the ink lands. The voltage detection circuit 54A includes an integration circuit 54*a* which integrates a voltage signal of the print head 24 to output the integrated signal, an inverting amplifier circuit 54*b* which subjects the signal outputted from the integration circuit 54*a* to inverting amplification to output the amplified signal and an A/D converter circuit 54*c* which A/D converts the signal outputted from the inverting amplifier circuit 54*b* to output the A/D converted signal to the controller 70. Since the voltage variation caused by the flying and landing of one ink droplet is small, the integration circuit 54*a* integrates the voltage variation caused by the flying and landing of a plurality of ink droplets ejected from the same nozzle 23, and thus outputs the signal a large voltage variation. The inverting amplifier circuit 54*b* inverts the positive and negative of the voltage variation and amplifies the signal outputted from the integration circuit at a predetermined amplifying ratio decided by the circuit configuration to output the amplified signal. The A/D converter circuit 54*c* converts the analog signal outputted from the inverting amplifier circuit 54*b* to a digital signal to output the converted signal to the controller 70. As shown in FIG. 2, the inspection areas 52B to 52D and 62A to 62D are connected to the voltage application circuits 53B to 53D and 63A to 63D and the voltage detection circuits 54B to 54D and 64A to 64D, respectively, as in the case of the inspection area 52A, and configured to detect the electrical variation caused by the landing of the ink droplets in the inspection areas.

As shown in FIG. 1, the controller 70 is configured as a CPU 72-based microprocessor and includes a flash ROM 74 which stores various processing programs and in which data can be written and erased, a RAM 76 which temporarily stores or saves data, an interface (I/F) 78 through which information is sent/received to/from an exterior device, and input and output ports (not shown). In the flash ROM 74, the processing programs of a main routine, a nozzle inspection routine, a cleaning routine and printing routine to be described later are stored. In the RAM 76, a print buffer area is provided and print data sent via the I/F 78 from a user PC 80 is stored in the print buffer area. To the controller 70, the voltage signals outputted from the voltage detection circuits 54 of the nozzle inspection device 50 are inputted via the input port (not shown) and a print job outputted from the user PC 80 is inputted via the I/F 78. From the controller 70, a control signal for the print head 24 (including the piezoelectric elements 48), a control signal for the driving motor 33, a control signal for the carriage motor 34*a*, a control signal for the nozzle inspection device 50 (including the voltage application circuits 53 and the switches SW) and the like are outputted via the output port (not shown) and print status information for the user PC 80 is outputted via the I/F 78.

Figure 4:
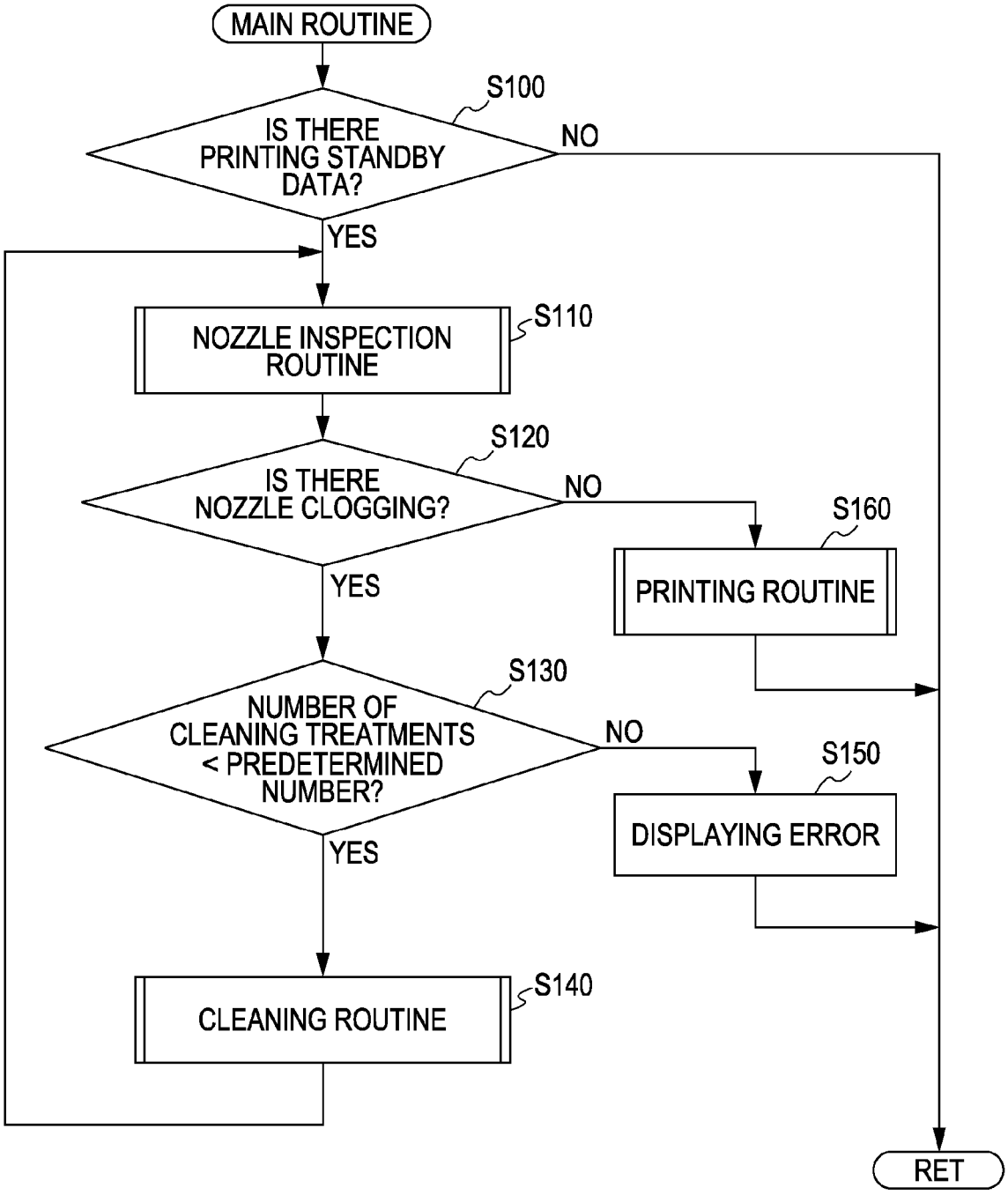
FIG. 4 is an exemplary flow chart of a main routine which is performed by a CPU 72.

Next, the operations of the printer 20 according to this embodiment will be described. Firstly, the operation of the main routine will be described based on FIG. 4. FIG. 4 shows an exemplary flow chart of the main routine performed by the CPU 72 of the controller 70. This routine is repeatedly performed by the CPU 72 at each predetermined timing (for example, every several milliseconds) after the printer 20 is turned on. When this routine starts, firstly, the CPU 72 determines whether there is a print job in a printing standby state (Step S100). The print job received from the user PC 80 is stored in the print buffer area formed in the RAM 76 to become a print job in a print standby state. Accordingly, when a print job is received, the print job becomes a print job in a print standby state in case where printing can be promptly performed in addition to the case where the printing is in process. In the Step S100, when it is determined that there is no print job in a print standby state, the main routine finishes as it is.

Figure 5:
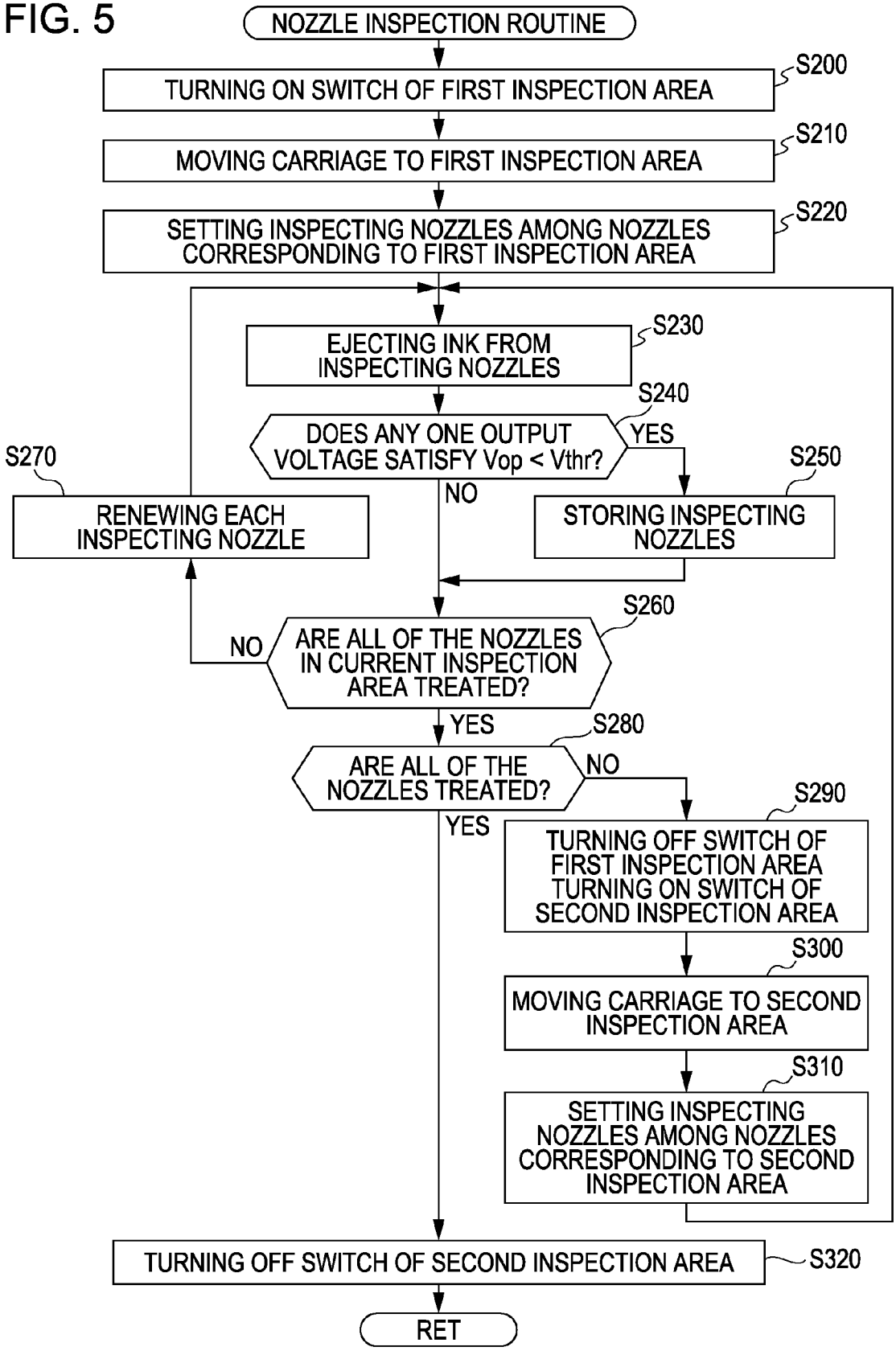
FIG. 5 is an exemplary flow chart of a nozzle inspection routine.
Figure 6:
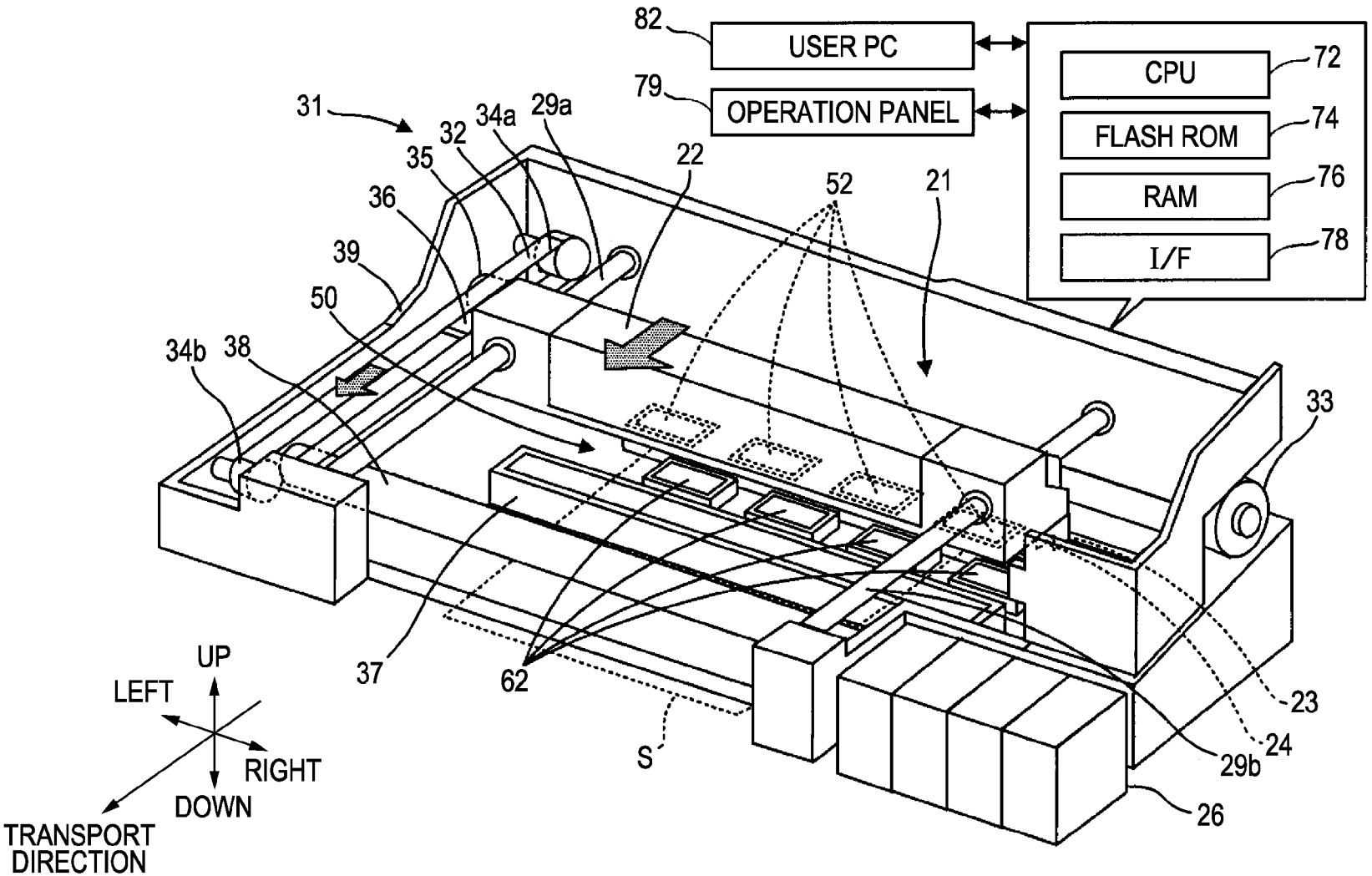
FIG. 6 is a diagram explaining the movement of a carriage 22.
Figure 7A:
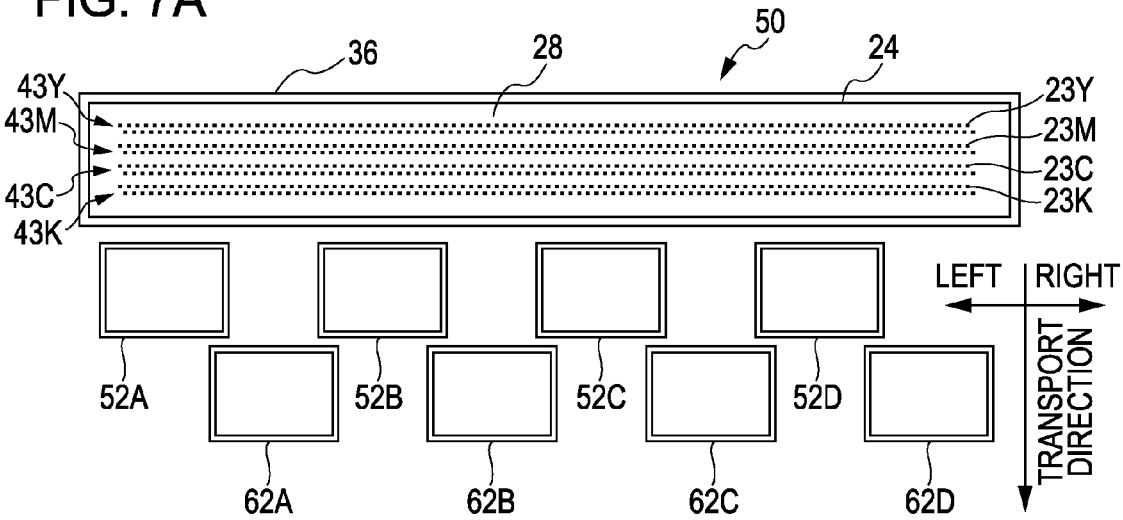
FIG. 7A is a plan view illustrating the print head 24 is in a print position.
Figure 7B:
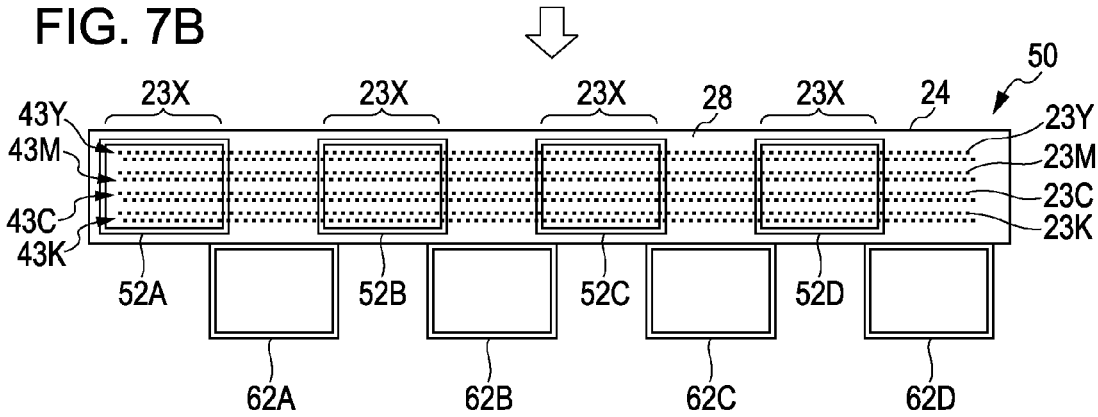
FIG. 7B is a plan view illustrating that the print head 24 is disposed over the first inspection areas 52.
Figure 7C:
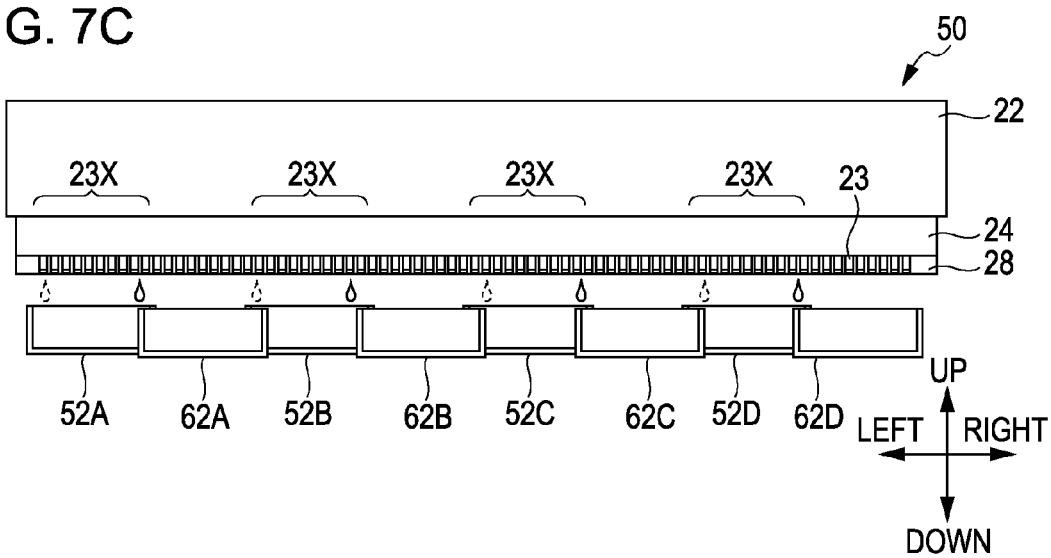
FIG. 7C is a front view illustrating that the print head 24 is disposed over the first inspection areas 52.
Figure 8A:
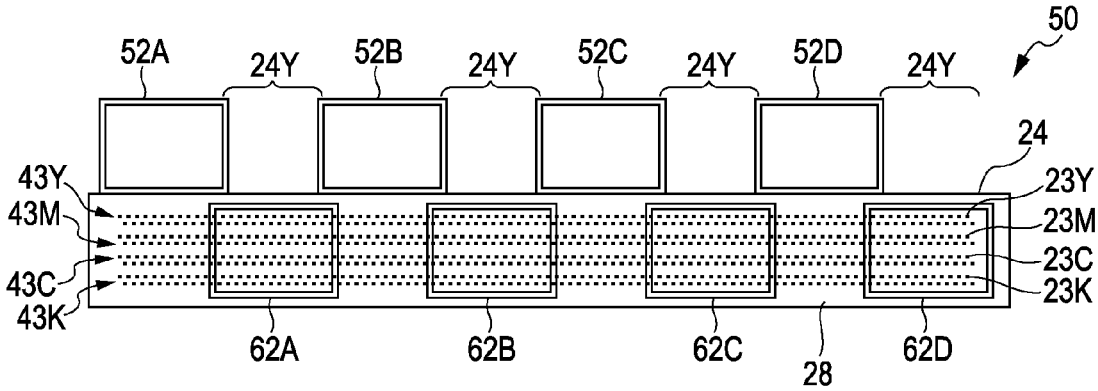
FIG. 8A is a plan view illustrating that the print head 24 is disposed over the second inspection areas 62.
Figure 8B:
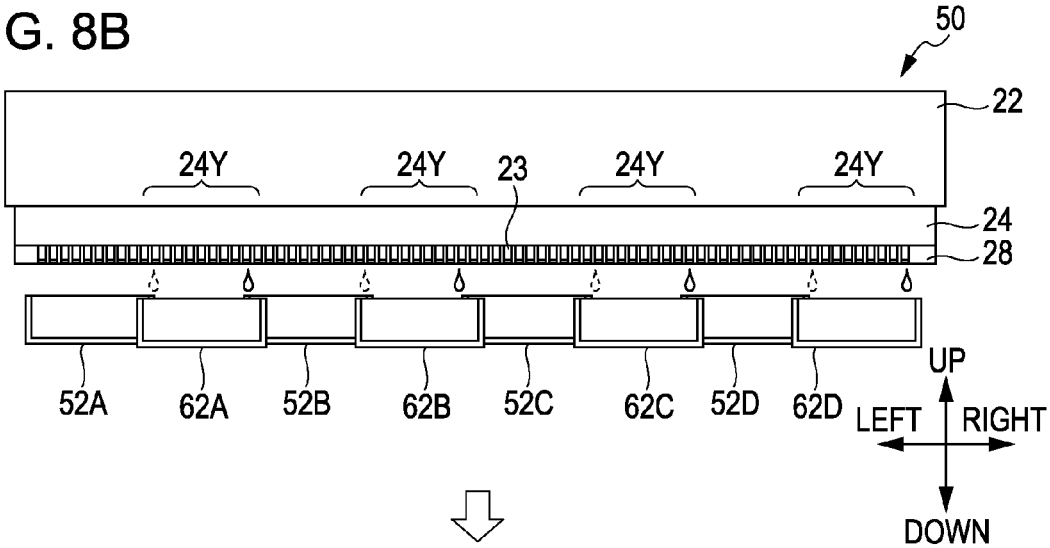
FIG. 8B is a front view illustrating that the print head 24 is disposed over the second inspection areas 62.
Figure 8C:
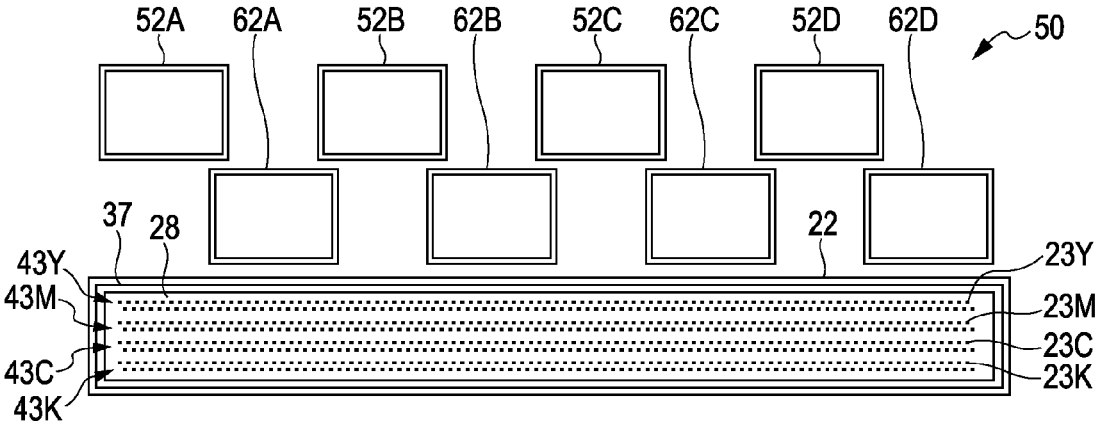
FIG. 8C is a view illustrating that the print head 24 is disposed over a capping device 37.

However, in the Step S100, when it is determined that there is a print job in a print standby state, the nozzle inspection routine inspecting whether the nozzles 23 normally eject the ink is performed (Step S110). FIG. 5 shows an exemplary flow chart of this nozzle inspection routine and FIG. 6 is a diagram explaining the movement of the carriage 22. FIGS. 7A to 7C are views explaining the print head 24 during the nozzle inspection. FIG. 7A is a plan view illustrating that the print head 24 is in a print position, FIG. 7B is a plan view illustrating that the print head 24 is disposed over the first inspection areas 52, and FIG. 7C is a front view illustrating that the print head 24 is disposed over the first inspection areas 52. FIG. 8A to 8C are views explaining the print head 24 during the nozzle inspection. FIG. 8A is a plan view illustrating that the print head 24 is disposed over the second inspection areas 62, FIG. 8B is a front view illustrating that the print head 24 is disposed over the second inspection areas 62, and FIG. 8C is a view illustrating that the print head 24 is disposed over the capping device 37. When the nozzle inspection routine starts, the print head 24 is disposed on the platen 36 (FIG. 7A). When the nozzle inspection routine starts, firstly, the CPU 72 turns on the switch SW for the voltage application circuits 53 and applies the DC voltages Ve to the first inspection areas 52 (Step S200). Then, the CPU 72 drives the carriage motor 34*a* so as to move the carriage 22 to a position at which the print head 24 and the first inspection areas 52 are opposed to each other, as shown in FIG. 6 (Step S210). In this manner, the print head 24 is opposed to the first inspection areas 52 (FIG. 7B) and predetermined potential differences are generated between the print head 24 and the first inspection areas 52.

Subsequently, among the nozzles 23 opposed to the inspection areas 52A to 52D of the first inspection areas 52, the CPU 72 sets the nozzles to be inspected (inspecting nozzles) for every area (Step S220). Herein, the nozzles 23 in margin areas partially overlapping with the second inspection areas 62 are not included in inspecting nozzle groups 23X of the first inspection areas 52 (see FIG. 7B) and the inspecting nozzles are set in the order of, for example, the nozzle arrays 43K, 43C, 43M and 43Y and in the order of nozzle number. Next, the CPU 72 drives the piezoelectric elements 48 (see FIG. 2) of the set inspecting nozzles of the areas to allow the charged ink droplets to be ejected from the inspecting nozzles (Step S230). Hereinafter, nozzle inspection will be described. In a state in which the nozzle plate 28 is grounded to be set at a ground potential to thereby generate potential differences between the nozzle plate 28 and the inspection areas 52 and 62, an experiment on ejecting the ink droplets from the nozzles 23 is actually performed. Output signal waveforms of the inspection areas 52 and 62 are indicated as sine curves. The principle with respect to the indication of the output signal waveforms is not clear. However, it is considered that this is because an inductive current flows by electrostatic induction in response to the approach of the charged ink droplets to the inspection areas 52 and 62. Further, the shorter the distance from the print head 24 to the upper ink absorbers 55 (inspection areas 52 and 62) and the larger the flying ink droplets, the larger the amplitudes of the output signal waveforms outputted from the voltage detection circuits 54 and 64. As a result, when the nozzles 23 are clogged and the ink droplets do not fly or have a smaller size than a predetermined size, the amplitudes of the output signal waveforms are smaller than the normal amplitudes or nearly 0, and thus it is determined whether the nozzles 23 are clogged based on whether the amplitudes of the output signal waveforms are less than a predetermined threshold. In this embodiment, the amplitudes of the output signal waveforms by the ink droplets corresponding to one shot are very small even when the ink droplets have a predetermined size. Accordingly, by performing 8 times an operation of outputting all of the three pulses of one segment indicating the driving waveforms, the ink droplets corresponding to 24 shots are ejected. Since output signals are integrated values obtained by the ink droplets corresponding to 24 shots, sufficiently large output signal waveforms are obtained from the voltage detection circuits 54. The number of ink ejection can be arbitrarily set such that inspection accuracy can be ensured.

When the ink droplets are ejected from the inspecting nozzles, the CPU 72 determines whether any one of the electrical variations as the amplitudes of the signal waveforms detected in the voltage detection circuits 54A to 54D, that is output voltages Vop, is smaller than a threshold Vthr (Step S240). The threshold Vthr is an empirically defined value, such that the output voltages Vop (peak values) of the output signal waveforms when the ink corresponding to 24 shots is normally ejected are the threshold Vthr or more or the output voltages of the output signal waveforms when the ink corresponding to 24 shots is not normally ejected are smaller than the threshold Vthr by noise or the like. In the Step S240, when any one of the output voltages Vop is less than the threshold Vthr, it is regarded that the nozzle 23 corresponding to this output voltage has a problem such as clogging and information specifying the nozzle 23 (for example, information representing which nozzle array has the clogged nozzle and what the clogged nozzle's number is) is stored in a predetermined area of the RAM 76 (Step S250). In this manner, the processes of the Steps S230 to S250 are performed in parallel, that is, performed at the same time in the inspection areas 52A to 52D.

After the Step S250, or when the output voltage Vop is the threshold Vthr or more in the Step S240 (that is, when the inspecting nozzle corresponding to this output voltage is normal), the CPU 72 determines whether all of the nozzles 23 which are inspected in the current inspection areas (first inspection areas 52) have been inspected (Step S260). When there are the nozzles 23 not inspected in the current inspection areas, the un-inspected nozzles 23 are renewed as nozzles to be inspected (Step S270) and then the Step S230 and the subsequent Steps are performed again. At this time, as shown in FIG. 7C, ink droplets are ejected to the inspection areas 52A to 52D and the electrical variations are outputted in the voltage detection circuits 54A to 54D (see FIG. 2). In the Step 260, when all of the nozzles 23 which are inspected in the current inspection areas have been inspected, it is determined whether all of the nozzles 23 included in the print head 24 have been inspected (Step S280), and when there are the un-inspected nozzles 23, the switch SW for the first inspection areas 52 is turned off and the switch SW for the second inspection areas 62 is turned on in order to inspect the un-inspected nozzles and the DC voltages Ve are applied to the second inspection areas 62 (Step S290). The carriage motor 34*a* is driven so as to move the carriage 22 to a position at which the print head 24 and the second inspection areas 62 are opposed to each other (Step S300). In this manner, the print head 24 is opposed to the second inspection areas 62 (FIG. 8A) and predetermined potential differences are generated between the print head 24 and the second inspection areas 62.

Subsequently, among the nozzles 23 opposed to the inspection areas 62A to 62D of the second inspection areas 62, the CPU 72 sets, for every area, the inspecting nozzles of inspecting nozzle groups 24Y including the un-inspected nozzles 23 on the basis of, for example, the same rules as those of the above-mentioned Step S220 (Step S310) and the Steps S230 to S280 are performed in the second inspection areas 62. That is, ink droplets are ejected to the inspection areas 62A to 62D (FIG. 8B), determinations of inspecting whether the output voltages Vop detected by the voltage detection circuits 64A to 64D are smaller than the threshold Vthr are performed in parallel, that is, performed at the same time, and information specifying the nozzles 23 corresponding to the output voltages Vop smaller than the threshold Vthr as the clogged nozzles is stored in a predetermined area of the RAM 76. All of the remaining nozzles are subjected to these processes. In Step S280, when it is determined that all of the nozzles 23 included in the print head 24 have been inspected, the CPU 72 turns off the switch SW for the second inspection areas 62 (Step S320) and this routine finishes. When there are the clogged nozzles 23 among all of the nozzles 23 arranged in the print head 24, a predetermined area of the RAM 76 stores the information specifying the clogged nozzles 23 by performing this routine, and when there is no clogged nozzle 23, a predetermined area of the RAM 76 do not store any information.

Returning to the main routine of FIG. 4, the above-mentioned nozzle inspection routine (Step S110) is performed and then the CPU 72 determines whether there are the clogged nozzles 23 among all of the nozzles 23 arranged in the print head 24 on the basis of the contents stored in the predetermined areas of the RAM 76 (Step S120). When there are the clogged nozzles 23, cleaning for the print head 24 is performed in consideration of the clogging. However, before the cleaning, it is determined that the number of cleaning treatments for the nozzle clogging is equal to an upper limit (for example, three times) (Step S130). When the number of cleaning treatments is less than the upper limit, the cleaning treatment for the print head 24 is performed (Step S140). Specifically, the carriage motor 34*a* is driven to move the print head 24 to a position opposed to the capping device 37 such that the capping device 37 and the print head 24 are brought into contact with each other. Then, the open/close valve is closed and the suction pump is driven to generate a negative pressure in the interior space of the capping device 37. The stuck ink is sucked and discharged from the nozzles 23 (FIG. 8C). By performing this cleaning treatment, the ink accumulating in the nozzles 23 (for example, the ink having high viscosity by being left for a long period of time) can be removed.

After the cleaning treatment is performed in Step S140, the nozzle inspection routine of Step S110 is repeated again in order to determine whether the nozzle clogging of the nozzles 23 is eliminated. In this Step S110, only the clogged nozzles 23 may be re-inspected. Herein, however, all of the nozzles 23 of the print head 24 are re-inspected since the normal nozzles 23 may be clogged during the cleaning treatment by some reasons. On the other hand, in the Step S130, when the number of cleaning treatments equal to the upper limit, it is regarded that the clogged nozzles 23 are not normalized even when the cleaning treatment is performed. Accordingly, an error message is displayed on an operation panel (not shown) (Step S150) and this main routine finishes. When it is determined that there is no clogged nozzle 23 in the Step S120, a printing routine is performed (Step S160) and then the main routine finishes.

Herein, a description will be given to make correspondence relationships between the compartments of this embodiment and the compartments of this invention clear. The print head 24 according to this embodiment corresponds to the ejection head according to the invention, the inspection areas 52 and 62 correspond to the fluid receiving areas according to the invention, the voltage application circuits 53 and 63 correspond to the potential difference generating unit according to the invention, the voltage detection circuits 54 and 64 correspond to the electrical variation detecting units according to the invention, the controller 70 corresponds to the control unit according to the invention, the carriage belt 32, the carriage motor 34*a* and the driven roller 34*b* correspond to the moving mechanism according to the invention, the first inspection areas 52 correspond to the first fluid receiving area according to the invention, the second inspection areas 62 correspond to the second fluid receiving area according to the invention, the ink corresponds to the fluid, and the recording sheet S corresponds to the target according to the invention. In addition, in this embodiment, the operations of the printer 20 are described to make an example of the ejection inspecting method according to the invention clear.

In the printer 20 according to the above-mentioned embodiment, in a state in which predetermined potential differences are generated between the print head 24 including the plurality of nozzles 23 ejecting ink and the plurality of inspection areas 52 and 62 corresponding to the print head 24 to receive the ink ejected from the plurality of nozzles 23, the print head 24 is driven so as to eject the ink to the plurality of inspection areas 52 and 62 from the nozzles 23 and the nozzle inspection processes determining whether the ink is ejected from the nozzles 23 are performed in parallel on the basis of the detection results of the electrical variations in the inspection areas 52 and 62 to which the ink is ejected. Herein, for example, when one inspection area is provided for one print head 24, only the electrical variation of the ink ejected from one nozzle 23 is detected. However, according to the invention, the plurality of inspection areas 52 and 62 and the plurality of voltage detection circuits 54 and 64 are provided so as to correspond to the print head 24 such that the inspection processes for the plurality of nozzles 23 are performed in parallel. Consequently, in detection of the electrical variations caused by the ejected ink, a period of time for nozzle inspection can be reduced. Since the second inspection areas 62 are provided so as to be arranged parallel to the first inspection areas 52 and the head moving mechanism 31 are provided to move the print head 24 to the position at which the first inspection areas 52 are opposed to the print head 24 and the position at which the second inspection areas 62 are opposed to the print head 24 in a direction perpendicular to the nozzle arrays 43, the detected values of the electrical variations can be kept constant with the distance between the print head 24 and the plurality of inspection areas 52 and 62 kept constant. Further, a period of time for nozzle inspection can be reduced and the nozzle inspection can be more accurately performed. Since the first inspection areas 52 are disposed at intervals so as to be opposed to the nozzles 23 of the print head 24 and the second inspection areas 62 are disposed at intervals so as to be opposed to the nozzles 23 of the print head 24 corresponding to the areas of the intervals between the first inspection areas 52, the mutual interferences, such as the conduction of the areas by the ink or the landing of the ink droplets on the next area, can be suppressed, and thus the nozzle inspection can be more accurately performed. Since the first inspection areas 52 and the second inspection areas 62 are disposed such that the nozzles 23 opposed to the first inspection areas 52 and the nozzles 23 opposed to the second inspection areas 62 partially overlap with each other, the mounting location accuracies of the inspection areas 52 and 62 can be improved. Since the inspection areas 52 and 62 are electrically insulated from each other, the inspection areas 52 and 62 can be prevented from being affected by the electrical variations and the nozzle inspection can be more accurately performed. Generally, the printer 20 performs printing by ejecting the ink to the recording sheet S, and then performs the nozzle inspection. Accordingly, the invention has great significance. Since the printer 20 includes the line head, a period of time for nozzle inspection of the line head in which a large number of the nozzles 23 are formed in one print head 24 can be reduced.

It should be noted that the invention is not limited to the above-mentioned embodiment and can be variously modified without departing from the technical scope of the invention.

For example, in the above-mentioned embodiment, the voltage application circuits 53 and 63 and the voltage detection circuits 54 and 64 are provided for the inspection areas 52A to 52D and 62A to 62D, respectively. However, since the inspection of the inspection areas 52A and 62A and the inspection of the inspection areas 52B and 62B are not performed at the same time, the voltage application circuit and the voltage detection circuit may be shared by the inspection areas 52A and 62A and the inspection areas 52B and 62B. In this manner, the configuration can be simplified. The first inspection areas 52 and the second inspection areas 62 have 4 inspection areas, respectively. However, the first and second inspection areas may be provided with one or more inspection areas, respectively.

Figure 9A:
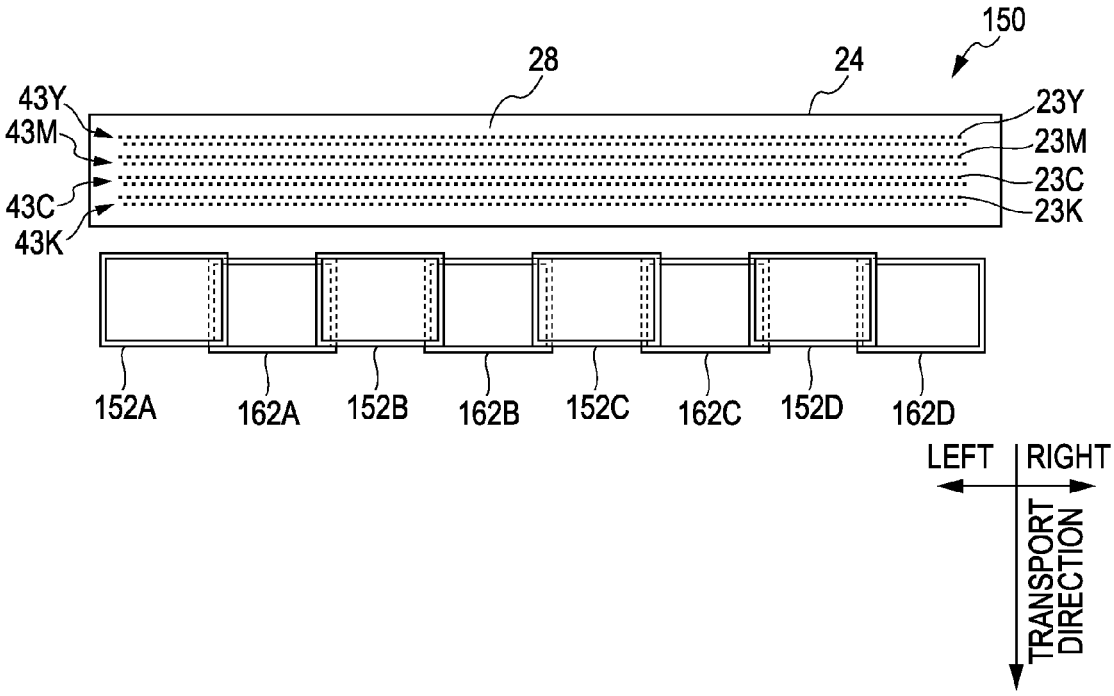
FIG. 9A is a plan view explaining a nozzle inspection device 150.
Figure 9B:
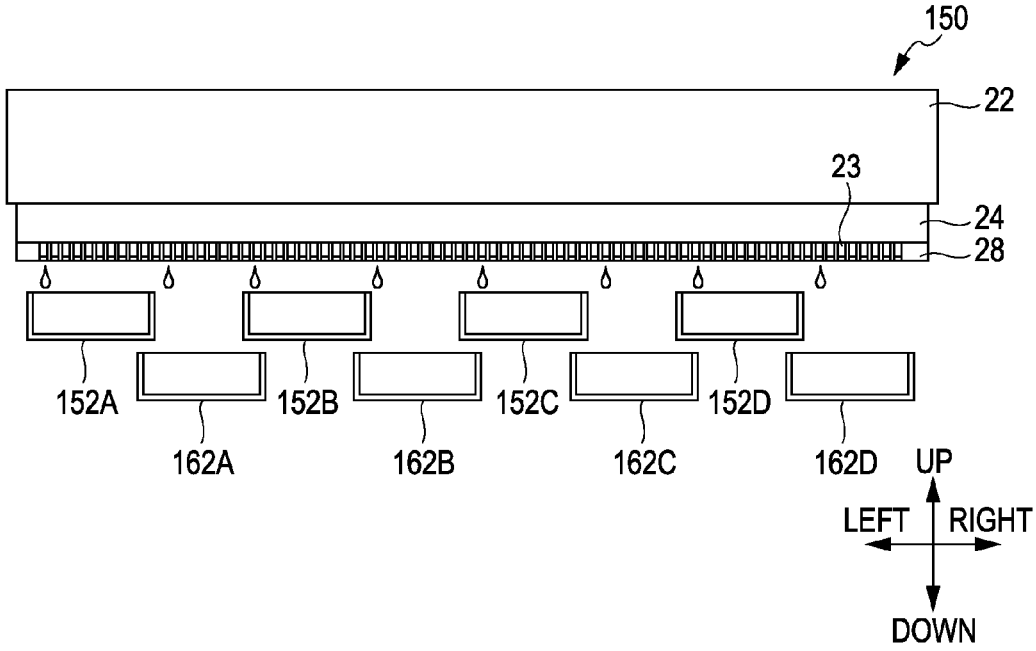
FIG. 9B is a front view explaining the nozzle inspection device 150.
Figure 10A:
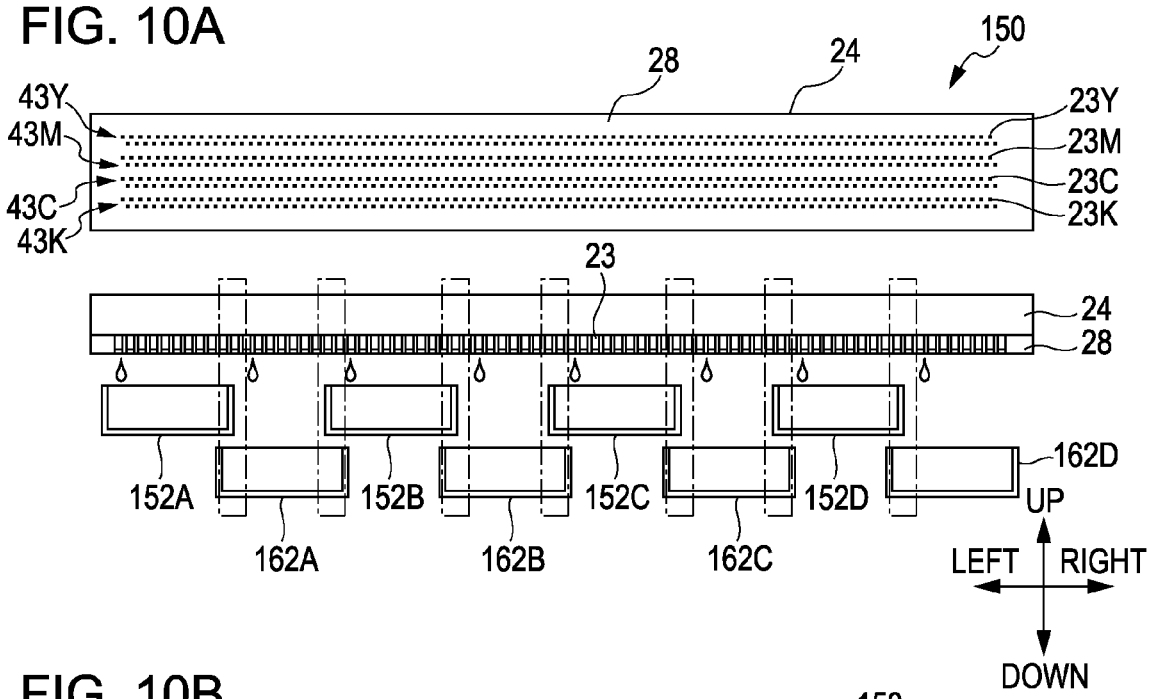
FIG. 10A is a view illustrating that nozzle inspection is performed by the nozzle inspection device 150 in inspection areas excluding end portions thereof.
Figure 10B:
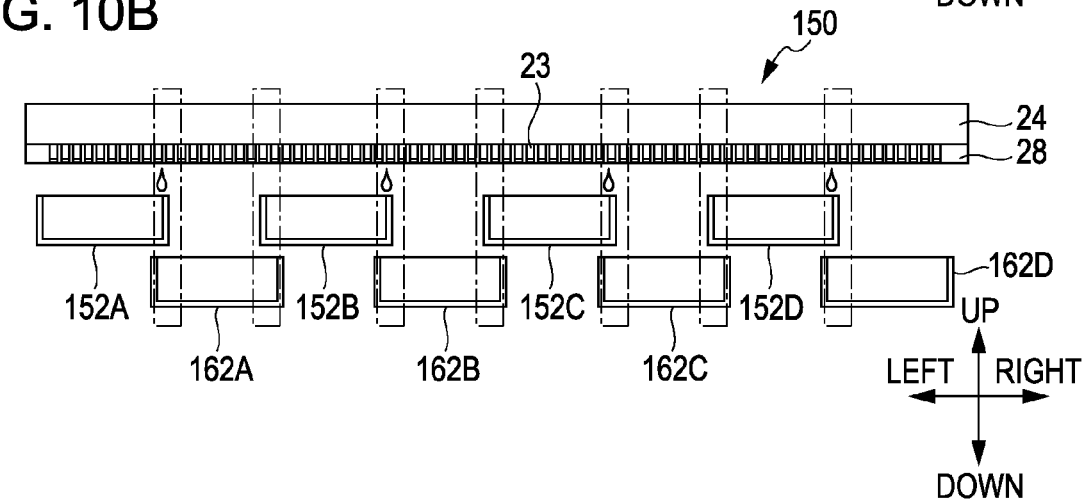
FIG. 10B is a view illustrating that the nozzle inspection is performed by the nozzle inspection device 150 in one end portions of the inspection areas.
Figure 10C:
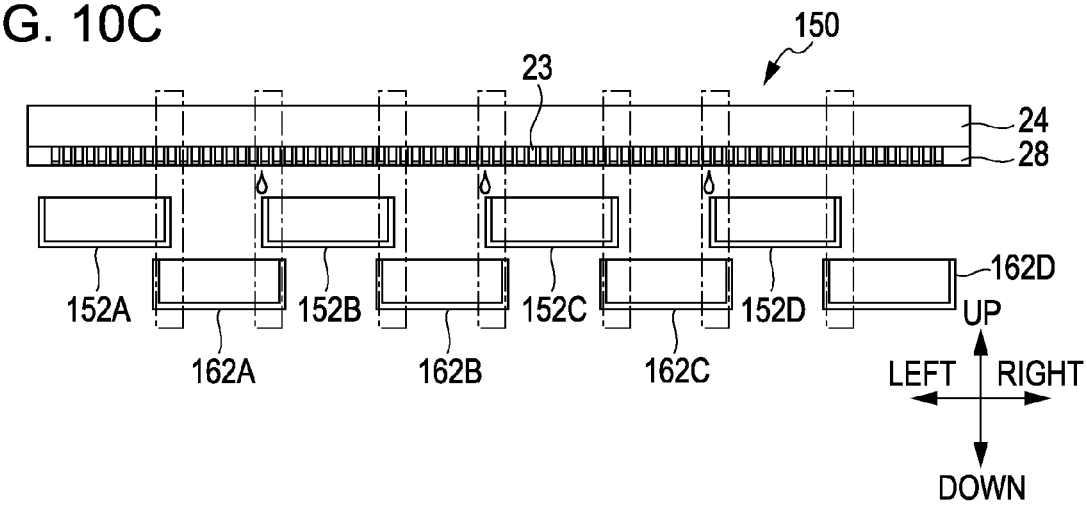
FIG. 10C is a view illustrating that the nozzle inspection is performed by the nozzle inspection device 150 in the other end portions of the inspection areas.

In the above-mentioned embodiment, the nozzle inspection device 50 is provided, in which the first inspection areas 52 and the second inspection areas 62 are arranged in parallel. However, as shown in FIGS. 9A and 9B and 10A to 10C, a nozzle inspection device 150 may be provided, in which first inspection areas 152 and second inspection areas 162 are arranged one above and the other below. FIGS. 9A and 9B are views explaining the nozzle inspection device 150. FIG. 9A is a plan view and FIG. 9B is a front view. FIGS. 10A to 10C are views explaining nozzle inspection performed by the nozzle inspection device 150. FIG. 10A is a view illustrating that the nozzle inspection is performed in the inspection areas excluding end portions thereof, FIG. 10B is a view illustrating that the nozzle inspection is performed in one end portions of the inspection areas, and FIG. 10C is a view illustrating that the nozzle inspection is performed in the other end portions of the inspection areas. In this nozzle inspection device 150, first inspection areas 152 including a plurality of inspection areas 152A to 152D are disposed at predetermined intervals in a width direction of a recording sheet S in the downstream of a transport direction of a platen 36. In addition, below the areas of the predetermined intervals of the first inspection areas 152 (ink ejection direction), second inspection areas 162 including a plurality of inspection areas 162A to 162D are arranged at predetermined intervals in the width direction of the recording sheet S. The first inspection areas 152 and the second inspection areas 162 are disposed such that nozzles 23 which are opposed to the first inspection areas 152 by positioning a carriage 22 over the first inspection areas 152 and nozzles 23 which are opposed to the second inspection areas 162 by positioning the carriage 22 over the second inspection areas 162 partially overlap with each other. The inspection areas 152A to 152D and 162A to 162D have outer circumferential portions made of a conductive material, respectively, are formed independently from each other in a state in which the areas thereof are disposed away from each other, and are insulated from each other. The inspection areas 152A to 152D and 162A to 162D have the same configurations. Next, the nozzle inspection of the nozzle inspection device 150 will be described. In the nozzle inspection device 150, the first and second inspection areas 152 and 162 are formed just below a print head 24 and all of nozzle arrays 43 are opposed to the inspection areas. Accordingly, inspecting nozzles can be set for every inspection area (FIG. 9B). From the inspecting nozzles set in this manner, ink droplets are ejected to detect electrical variations of the areas and perform the nozzle inspection. Since the distance between the print head 24 and the first inspection areas 152 is shorter than the distance between the print head 24 and the second inspection areas 162, output voltages Vop detected by voltage detection circuits 154 are larger than output voltages Vop detected by voltage detection circuits 164, and thus, herein, a threshold Vthr of the second inspection areas 162 is set to be smaller than that of the first inspection areas 152. The number of dots and the ejection amount may be appropriately changed and the same threshold Vthr may be used so as to adjust the output voltages Vop to the same values. In addition, when ink droplets are ejected to the end portions of the first inspection areas 152 and the end portions of the second inspection areas 162 which overlap with each other, the ink droplets may flight in a curved line and land on the different inspection area from the preliminarily targeted inspection area. For this reason, in the end portions of the inspection areas, the nozzle inspection in the first inspection areas 152 and the nozzle inspection in the second inspection areas 162 are not performed in parallel to prevent the overlapping ink droplet landing. That is, as shown in FIG. 10A, the inspecting nozzles for the inspection areas excluding the end portions are set so as to correspond to the inspection areas and eject the ink. Further, as shown in FIG. 10B, the inspecting nozzles ejecting the ink droplets to the second inspection areas 162 are not set for one ends of the first inspection areas 152 (right ends of FIG. 10B). That is, for example, when the nozzle inspection is performed in the right ends of the first inspection areas 152, the inspecting nozzles are set only for the first inspection areas 152 and the output voltages Vop are detected in any of the first inspection areas 152 and the second inspection areas 162. Then, when the detected output voltages Vop are not less than the thresholds Vthr set for the areas, it is determined that the ink has been ejected. Similarly, as shown in FIG. 10C, for example, the inspecting nozzles for the other ends of the first inspection areas 152 (left ends of FIG. 10C) are set only for the second inspection areas 162 and the output voltages Vop are detected in any of the first inspection areas 152 and the second inspection areas 162. Then, when the detected output voltages Vop are not less than the thresholds Vthr set for the areas, it is determined that the ink has been ejected. In the nozzle inspection device 150 configured in this manner, it is not necessary to move the print head 24 during the nozzle inspection and the nozzle inspection of the first inspection areas 152 and the nozzle inspection of the second inspection areas 162 can be performed in parallel. Accordingly, a period of time for nozzle inspection can be reduced in comparison with the case where the print head 24 is moved during the nozzle inspection. Moreover, the nozzle inspection processes are not performed in parallel in the end areas to accurately perform the nozzle inspection and the nozzle inspection processes are performed in parallel in the areas other than the end areas, and thus a period of time for nozzle inspection can be reduced.

Figure 11A:
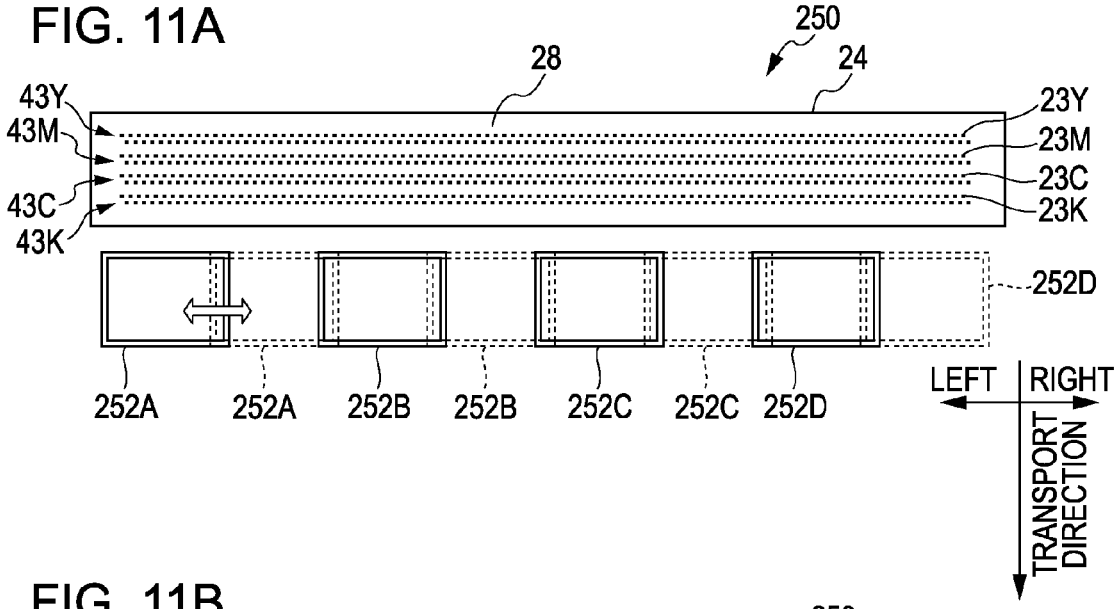
FIG. 11A is a plan view illustrating a nozzle inspection device 250.
Figure 11B:
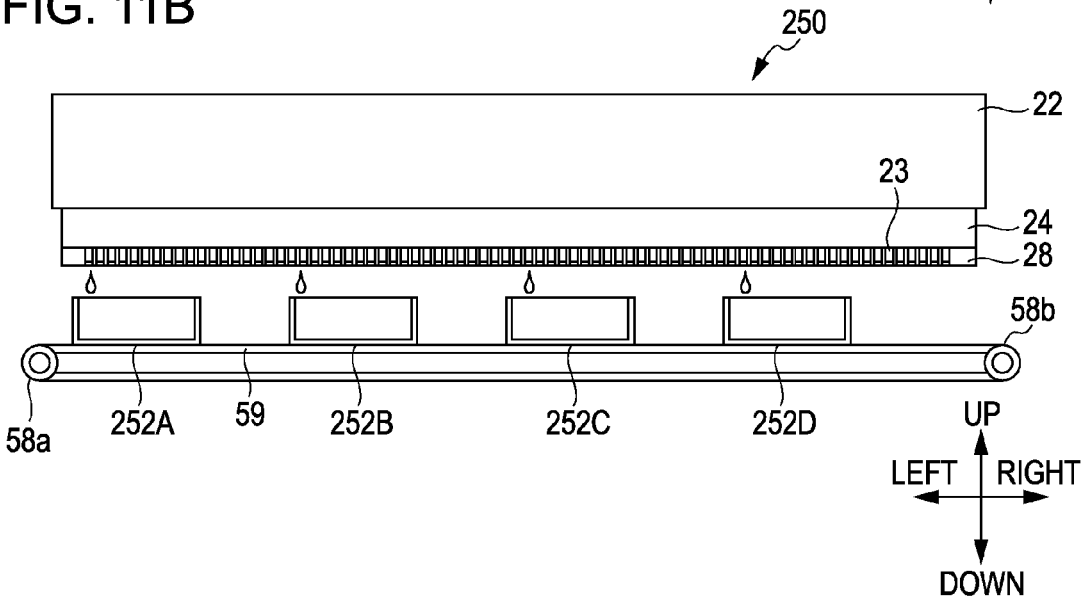
FIG. 11B is a view explaining an initial state of the nozzle inspection device 250.
Figure 11C:
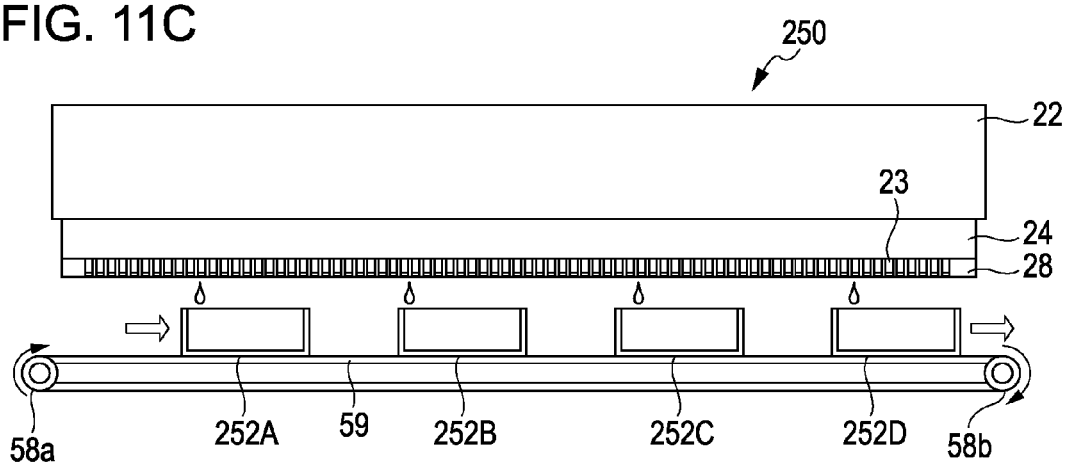
FIG. 11C is a view explaining a state of the nozzle inspection device 250 after inspection areas 252 are moved.

As shown in FIG. 11, a nozzle inspection device 250 may be provided, which includes a plurality of inspection areas 252A to 252D supported so as to be moved in a direction of nozzle arrays 43 of a print head 24. FIGS. 11A to 11C are view explaining the nozzle inspection device 250. FIG. 11A is a plan view, FIG. 11B is a view explaining an initial state, and FIG. 11C is a view explaining a state after inspection areas 252 are moved. In the nozzle inspection device 250, in the downstream of a transport direction of a platen 36, the inspection areas 252 including a plurality of inspection areas 252A to 252D are arranged at predetermined intervals in a width direction of a recording sheet S. Below the inspection areas 252, an inspection area belt 59 extending between an inspection area motor 58*a* mounted on the left side of a frame 39 (see FIG. 1) and a driven roller 58*b* mounted on the right side of the frame 39 is provided and the inspection areas 252 are arranged on the inspection area belt 59. Consequently, the inspection areas 252 are moved in a left-right direction of FIG. 11B by the inspection area belt 59 driven by the inspection area motor 58*a*. Nozzle groups opposed to the inspection areas when the inspection areas 252 are in initial positions thereof are set as inspecting nozzles, and ink is ejected to the inspection areas from the nozzle groups (FIG. 11B). After that, the inspection areas 252 are moved to positions opposed to nozzle groups different from the above-mentioned nozzle groups by driving the inspection area motor 58*a*, and then inspecting nozzles are set and nozzle inspection is performed (FIG. 11C). In this manner, the nozzle inspection processes are performed in parallel by using the plurality of inspection areas, and thus a period of time for nozzle inspection can be reduced, and the ink droplets ejected from all of the nozzles 23 provided in the print head 24 can be received by moving the plurality of inspection areas 252A to 252D. As a result, the inspection areas 252 can be relatively reduced in space. Herein, the inspection areas 252 are moved in the direction of the nozzle arrays 43. However, in place of or in addition to this, the print head 24 may be moved in the direction of the nozzle arrays 43.

Figure 12:
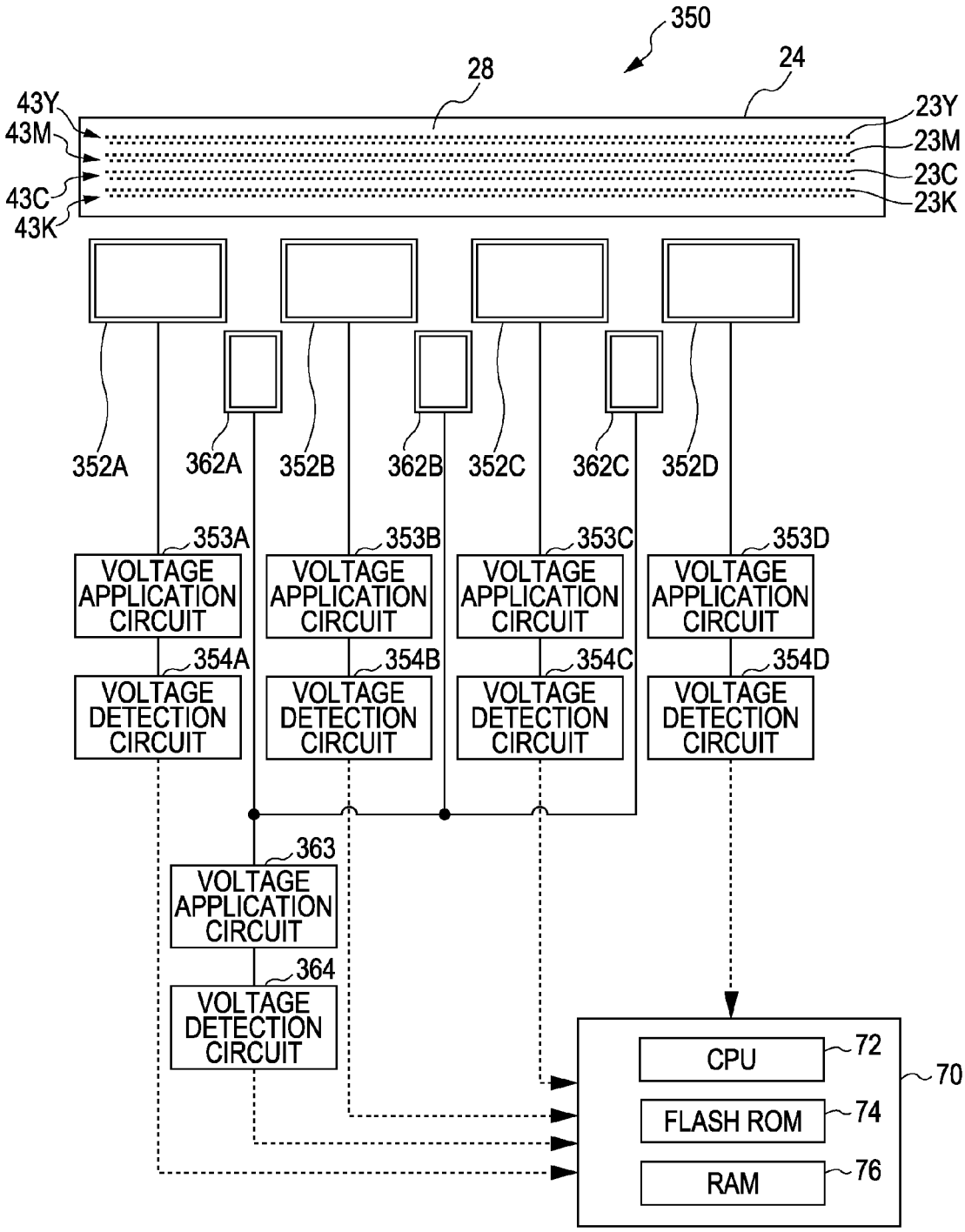
FIG. 12 is a view explaining a nozzle inspection device 350.
Figure 13A:
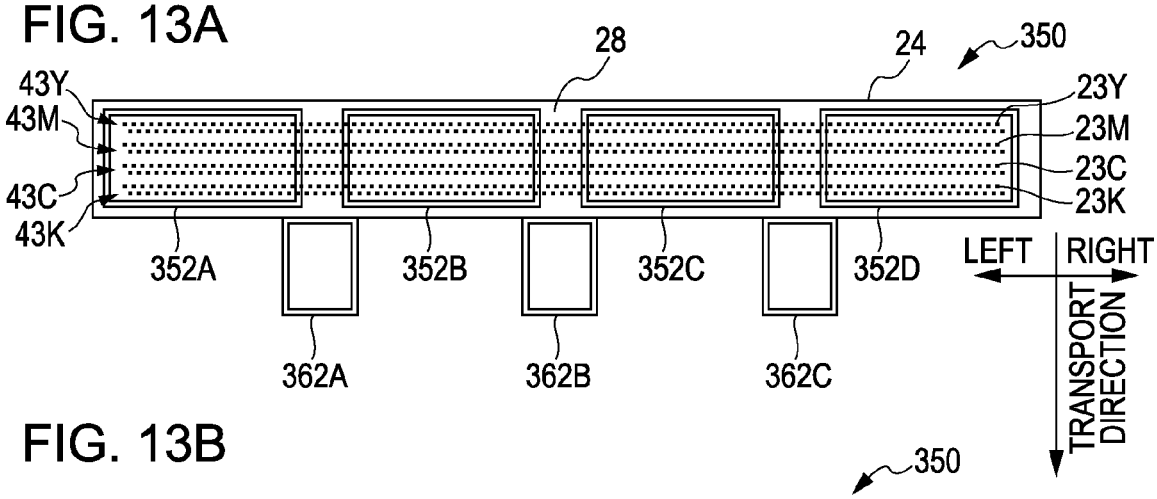
FIG. 13A is a plan view illustrating that nozzle inspection is performed by the nozzle inspection device 350 in first inspection areas 352.
Figure 13B:
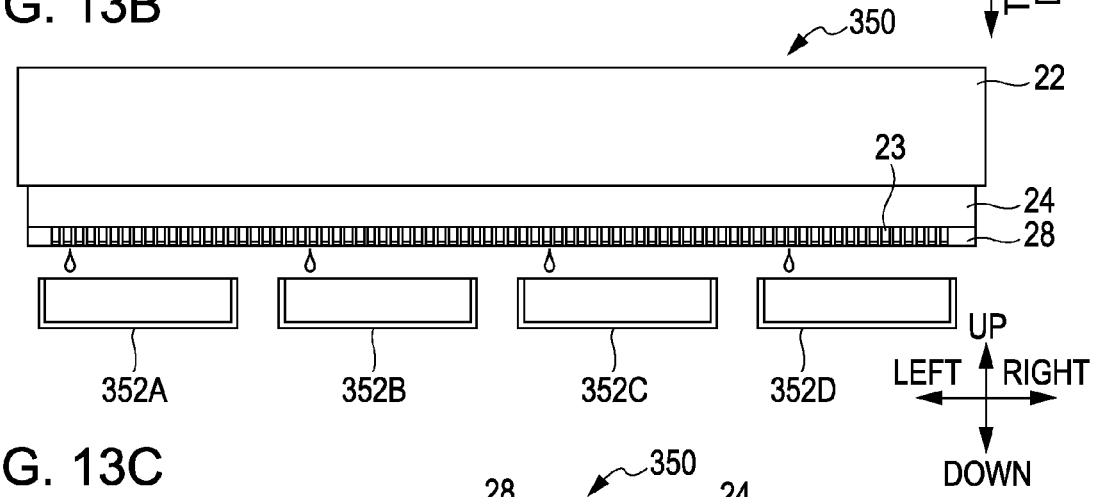
FIG. 13B is a front view illustrating that the nozzle inspection is performed by the nozzle inspection device 350 in first inspection areas 352.
Figure 13C:
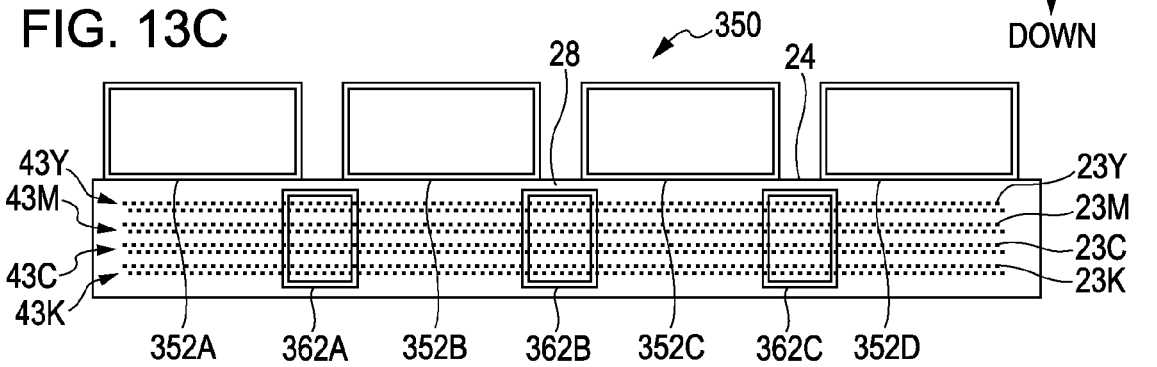
FIG. 13C is a plan view illustrating that the nozzle inspection is performed by the nozzle inspection device 350 in second inspection areas 362.
Figure 13D:
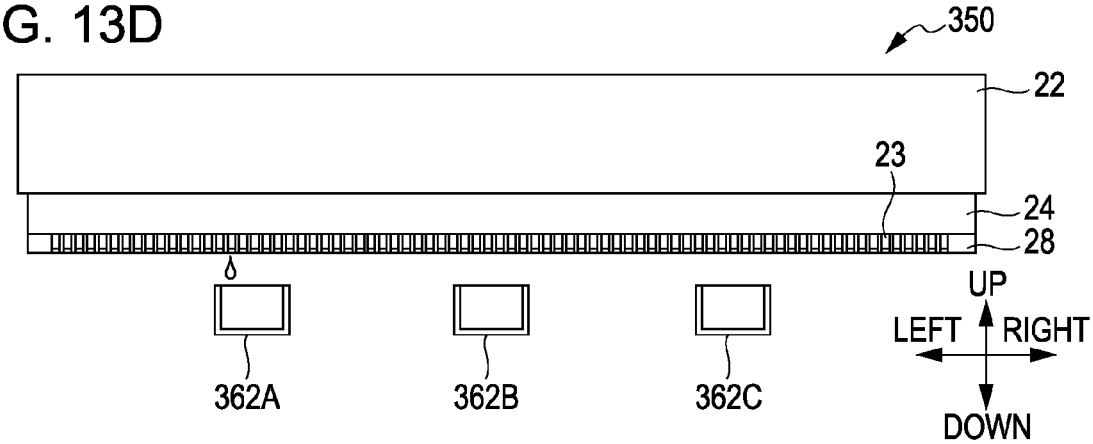
FIG. 13D is a front view illustrating that the nozzle inspection is performed by the nozzle inspection device 350 in second inspection areas 362.

In the above-mentioned embodiment, the first inspection areas 52 and the second inspection areas 62 have the same size inspection areas. However, as shown in FIGS. 12 and 13A to 13D, first inspection areas 352 and second inspection areas 362 may include different size inspection areas. FIG. 12 is a view explaining a nozzle inspection device 350. FIG. 13A to 13D are views explaining the nozzle inspection performed by the nozzle inspection device 350. FIG. 13A is a plan view illustrating that the nozzle inspection is performed in the first inspection areas 352, FIG. 13B is a front view illustrating that the nozzle inspection is performed in the first inspection areas 352, FIG. 13C is a plan view illustrating that the nozzle inspection is performed in the second inspection areas 362, and FIG. 13D is a front view illustrating that the nozzle inspection is performed in the second inspection areas 362. In the nozzle inspection device 350, in the downstream of a transport direction of a platen, first inspection areas 352 including a plurality of inspection areas 352A to 352D are arranged at predetermined intervals in a width direction of a recording sheet S. The sizes of the inspection areas 352A to 352D are large such that most of nozzles 23 (for example, more than 80 percent) provided in a print head 24 are opposed to the inspection areas 352A to 352D. In the downstream of the transport direction of the areas of the intervals of the first inspection areas 352 are arranged at the predetermined intervals, second inspection areas 362 including a plurality of inspection areas 362A to 362C with a smaller width than the inspection areas 352A to 352D are arranged at predetermined intervals in the width direction of the recording sheet S. The second inspection areas 362 are arranged in the same side as the first inspection areas 352 opposed to the print head 24. Further, the first inspection areas 352 and the second inspection areas 362 are arranged such that the nozzles 23 arranged over the first inspection areas 352 and opposed to the first inspection areas 352 and the nozzles 23 arranged over the second inspection areas 362 and opposed to the second inspection areas 362 partially overlap with each other. The inspection areas 352A to 352D and 362A to 362C have outer circumferential portions made of a conductive material, respectively, are formed independently from each other in a state in which the areas thereof are disposed away from each other, and insulated from each other. The inspection areas 352A to 352D have the same configurations and the inspection areas 362A to 362C have the same configurations. As shown in FIG. 12, the inspection areas 352A to 352D are connected to voltage application circuits 353A to 353D and voltage detection circuits 354A and 354D and the inspection areas 362A to 362C are electrically connected to a shared voltage application circuit 363 and a shared voltage detection circuit 364. Next, the nozzle inspection of the nozzle inspection device 350 will be described. In the nozzle inspection device 350, the inspection processes in the first inspection areas 352 are performed in parallel as in the case of the above-mentioned nozzle inspection device 50 (FIGS. 13A and 13B) and then the print head 24 moves over the second inspection areas 362 to perform the nozzle inspection. Since the voltage detection circuit 364 is shared in the inspection of the second inspection areas 362, the nozzle inspection processes in the inspection areas 362A to 362C are individually performed. That is, the nozzle inspection is individually performed for every area (FIGS. 13C and 13D). By forming the second inspection areas 362 to be smaller than the first inspection areas 352, a period of time for individually performing the nozzle inspection processes in the second inspection areas 362 can be reduced, and by sharing the voltage application circuit 363 and the voltage detection circuit 364, the configuration can be simplified. The one shared voltage detection circuit 364 is connected to the second inspection areas 362, but one or more of the voltage detection circuits 364 may be shared for the inspection areas included in the second inspection areas 362. That is, herein, two shared voltage detection circuits 364 may be connected to the second inspection areas 362. The voltage application circuit 363 also has the same configuration.

In the above-mentioned embodiment, the inspection areas 52A to 52D and 62A to 62D are arranged at the predetermined intervals. However, they are may be arranged without the intervals. In the above-mentioned embodiment, the inspection areas 52A to 52D and 62A to 62D are electrically insulated from each other. However, this may be omitted.

In the above-mentioned embodiment, the nozzle inspection device 50 is provided between the sheet transport roller 35 and the sheet discharge roller 38, but may be provided outside the sheet transport roller 35 or the outside the sheet discharge roller 38. In the above-mentioned embodiment, the head moving mechanism 31 moves the carriage 22 in the same direction as the transport direction, but may move the carriage 22 in a direction (for example, the arrangement direction of the nozzle arrays 43) perpendicular to the transport direction. In the above-mentioned embodiment, the print head 24 moves with respect to the nozzle inspection device 50. However, in place of or in addition to this, the nozzle inspection device 50 may move with respect to the print head 24.

In the above-mentioned embodiment, the nozzle inspection is performed in such a manner that the inspecting nozzle groups 23X and the inspecting nozzle groups 24Y including the nozzles 23 of different colors are caused to correspond to the inspection areas, but the nozzle inspection may be performed in such a manner that the specified nozzle arrays 43 are caused to correspond to the inspection areas. For example, the nozzle array 43K may be caused to correspond to the inspection area 52A and the nozzle array 43Y may be caused to correspond to the inspection area 52B. In this manner, the nozzle inspection processes can be performed in parallel in the plurality of inspection areas and thus a period of time for nozzle inspection can be reduced.

In the above-mentioned embodiment, in the Step S220, the nozzles 23 in the margin areas in which the first inspection areas 52 and the second inspection areas 62 partially overlap with each other are not included in the inspecting nozzle groups 23X of the first inspection areas 52, and in the Step S310, the nozzles 23 in the margin areas are included in the inspecting nozzle groups 24Y of the second inspection areas 62. However, the nozzles 23 in the margin areas may be equally divided into the nozzles opposed to the first inspection areas 52 and the nozzles opposed to the second inspection areas 62 in the arrangement direction of the nozzles to perform the nozzle inspection in the inspection areas. Otherwise, the nozzle inspection of the nozzles 23 in the margin areas may be performed in both the first inspection areas 52 and the second inspection areas 62 to obtain the logical sum of the inspection results in both the inspection areas. In this manner, the nozzle inspection in the end portions can be more accurately performed.

In the above-mentioned embodiment, the line head is provided, in which the nozzle arrays 43 are arranged in a direction perpendicular to the transport direction so as to have a length not less than a width of the largest sized one of the usable recording sheets S. However, the invention is not limited to this example, and for example, a print head which includes nozzle arrays of different colors and reciprocally moves in a direction (the width direction of the recording sheet) perpendicular to the transport direction may be provided and its nozzles may be inspected by using the plurality of inspection areas. In this manner, the nozzle inspection processes for one print head can be performed in parallel by using the plurality of inspection areas and a period of time for nozzle inspection can be reduced.

In the above-mentioned embodiment, the nozzle inspection routine is performed in the Step S110 when it is determined that there is the print data in a printing standby state in the Step S100 of the main routine. However, for example, the nozzle inspection routine may be performed every time the number of the movement of the carriage 22 is equal to a predetermined number (for example, for every 100 pass), may be performed at predetermined intervals (for example, at daily or weekly intervals), and may be performed by receiving an instruction for execution from a user through the operation of the operation panel (not shown). Further, the nozzle inspection routine may be performed when the printer 20 is inspected before shipment.

In the above-mentioned embodiment, the inspection areas 52 and 62 are provided with the upper ink absorber 55 and the lower ink absorber 56. However, one or both of the upper and lower ink absorbers may be omitted. For example, only the electrode 57 may be disposed to directly eject ink to the electrode 57. In addition, since predetermined potential differences are generated between the print head 24 and the electrode 57, the upper ink absorber 55 is not need to have conductivity. For example, the upper ink absorber 55 may be made of an insulating material.

In the above-mentioned embodiment, the example showing that the ejection inspecting device according to the invention is embodied in the printer 20 has been described. However, the ejection inspecting device according to the invention may be embodied in a fluid jet device jetting liquid other than the ink, a liquid substance (dispersion liquid) in which particles of a functional material are dispersed, or a jell-like liquid substance and may be embodied in a fluid jet device jetting a solid that can be jetted as fluid. For example, the ejection inspecting device according to the invention may be used for an ejection head which jets liquid in which a material, such as a color material or an electrode material which is used in manufacturing of a liquid crystal display, an EL (electroluminescence) display, a surface-emitting display and a color filter, is dissolved, an ejection head which jets a liquid substance in which the same material is dispersed, and an ejection head which is used as a precision pipette and jets a liquid specimen. In addition, the ejection inspecting device according to the invention may be used for an ejection head which jets lubricant to a precision machine such as a clock and a camera in a pinpoint manner, an ejection head which jets transparent resin liquid such as UV-curable resin on a substrate to form a minute hemispherical lens (optical lens) to be used in an optical communication element, an ejection head which jets etching liquid such as acid and alkali to etch a substrate, and an ejection head which jets powder such as toner.

In the above-mentioned embodiment, the printer 20 is configured as a printing device including the printer mechanism 21, but may be configured as a multifunction printer including a scanner or as a facsimile. Although aspects of the printer 20 have been described, the description may be applied to the nozzle inspection device 50, aspects of an ejection inspecting method or aspects of a program for the method.

What is claimed is:

1. An ejection inspecting device which inspects an ejection state of an ejection head including a plurality of nozzles ejecting fluid, the device comprising:

a plurality of fluid receiving areas corresponding to the ejection head so as to receive the fluid ejected from the plurality of nozzles;

a potential difference generating unit which generates predetermined potential differences between the ejection head and the fluid receiving areas;

a plurality of electrical variation detecting units which are connected to the plurality of fluid receiving areas so as to detect electrical variations of the fluid receiving areas; and a control unit which drives the ejection head so as to eject the fluid to the plurality of fluid receiving areas from the nozzles in a state in which the predetermined potential differences are generated between the ejection head and the fluid receiving areas by the potential difference generating unit and performs nozzle inspection for inspecting whether the fluid is ejected from the nozzles on the basis of the detection results of the electrical variation detecting units in the fluid receiving areas.

2. The ejection inspecting device according to claim 1, wherein the plurality of fluid receiving areas include a first fluid receiving area including one or more of the fluid receiving areas provided so as to be opposed to the ejection head and a second fluid receiving area including one or more of the fluid receiving areas provided so as to be arranged parallel to the first fluid receiving area, and wherein a moving mechanism is provided to move at least one of the ejection head and the fluid receiving areas to a position at which the first fluid receiving area and the ejection head are opposed to each other and a position at which the second fluid receiving area and the ejection head are opposed to each other.

3. The ejection inspecting device according to claim 2, wherein the plurality of fluid receiving areas include the first fluid receiving area including a plurality of the fluid receiving areas and the second fluid receiving area including a plurality of the fluid receiving areas smaller than those of the first fluid receiving area, wherein a smaller number of the electrical variation detecting units than those of the second fluid receiving area are shared by and connected to the second fluid receiving area, and wherein the control unit individually performs the nozzle inspection in the fluid receiving areas connected in common to the electrical variation detecting units.

4. The ejection inspecting device according to claim 2, wherein the plurality of fluid receiving areas include the first fluid receiving area including a plurality of the fluid receiving areas which are arranged at intervals so as to be opposed to the nozzles of the ejection head and the second fluid receiving area including a plurality of the fluid receiving areas which are arranged at intervals so as to be opposed to the nozzles of the ejection head corresponding to the areas of the predetermined intervals.

5. The ejection inspecting device according to claim 2, wherein the first fluid receiving area and the second fluid receiving area are arranged such that the nozzles opposed to the first fluid receiving area and the nozzles opposed to the second fluid receiving area partially overlap with each other.

6. The ejection inspecting device according to claim 1, wherein a nozzle array in which the nozzles are arranged in a predetermined arrangement direction is formed in the ejection head, and wherein the plurality of fluid receiving areas include a first fluid receiving area including one or more of the fluid receiving areas provided so as to be opposed to the ejection head and a second fluid receiving area including one or more of the fluid receiving areas provided in the arrangement direction of the nozzles at a distance different from a distance between the first fluid receiving area and the ejection head.

7. The ejection inspecting device according to claim 6, wherein the control unit does not perform the nozzle inspection in the first fluid receiving area and the nozzle inspection in the second fluid receiving area in parallel in an end area in which the first fluid receiving area and the second fluid receiving area overlap with each other.

8. The ejection inspecting device according to claim 1, wherein a nozzle array in which the nozzles are arranged in a predetermined arrangement direction is formed in the ejection head, wherein the plurality of fluid receiving areas are arranged at intervals in the arrangement direction of the nozzles, and wherein a moving mechanism is provided to move at least one of the ejection head and the plurality of fluid receiving areas in the arrangement direction of the nozzles to a position at which the plurality of fluid receiving areas and a predetermined nozzle group included in the ejection head are opposed to each other and a position at which the plurality of fluid receiving areas and the nozzles other than the predetermined nozzle group are opposed to each other.

9. The ejection inspecting device according to claim 1, wherein the plurality of fluid receiving areas are electrically insulated from each other.

10. A printing device comprising:

an ejection head which includes a plurality of nozzles ejecting fluid to a target; and the ejection inspecting device according to claim 1, which inspects an ejection state of the ejection head.

11. The printing device according to claim 10, wherein the ejection head is a line head in which a nozzle array including the nozzles arranged therein is formed so as to have a length not less than a width of the largest sized one of usable targets.

12. An ejection inspecting method used to inspect an ejection state of fluid by using an ejection inspecting device which includes an ejection head including a plurality of nozzles for ejecting the fluid, a plurality of fluid receiving areas corresponding to the ejection head so as to receive the fluid ejected from the plurality of nozzles, and a plurality of electrical variation detecting units connected to the plurality of fluid receiving areas and for detecting electrical variations of the fluid receiving areas, the method comprising:

driving the ejection head so as to eject the fluid to the plurality of fluid receiving areas from the nozzles in a state in which predetermined potential differences are generated between the ejection head and the fluid receiving areas, and performing nozzle inspection for inspecting whether the fluid is ejected from the nozzles on the basis of the detection results of electrical variations of the fluid receiving areas.

* * * * *

UNITED STATES PATENT AND TRADEMARK OFFICE

CERTIFICATE OF CORRECTION

PATENT NO. : 7,980,653 B2
APPLICATION NO. : 12/208034
DATED : July 19, 2011
INVENTOR(S) : Komatsu et al.

It is certified that error appears in the above-identified patent and that said Letters Patent is hereby corrected as shown below:

On the Face Page, in Field (74), under "Attorney, Agent or Firm", in Column 2, Line 1, delete "Maschoff Gilmore & Israelson" and insert -- Maschoff Gilmore & Israelsen --, therefor.

Signed and Sealed this
Twenty-fourth Day of July, 2012

David J. Kappos

David J. Kappos
*Director of the United States Patent and Trademark Office*